US006118951A

United States Patent [19]

Kato et al.

[11] Patent Number: 6,118,951

[45] Date of Patent: Sep. 12, 2000

[54] IMAGE FORMING APPARATUS AND TONER REPLENISHING DEVICE THEREFOR

[75] Inventors: Shunji Kato; Masasumi Yahata; Yuji Kitajima; Noboru Kusunose, all of Kanagawa, Japan

[73] Assignee: Ricoh Company, Ltd., Tokyo, Japan

[21] Appl. No.: 09/006,006

[22] Filed: Jan. 12, 1998

[30] Foreign Application Priority Data

| | | | |
|---|---|---|---|
| Jan. 13, 1997 | [JP] | Japan | 9-003839 |
| Feb. 7, 1997 | [JP] | Japan | 9-024996 |
| Mar. 21, 1997 | [JP] | Japan | 9-068256 |

[51] Int. Cl.[7] ..... G03G 15/08

[52] U.S. Cl. ..... 399/27; 399/30; 399/258; 399/259

[58] Field of Search ..... 399/27, 28, 29, 399/30, 24, 25, 258, 259, 260, 261, 262, 263

[56] References Cited

U.S. PATENT DOCUMENTS

| | | | |
|---|---|---|---|
| 4,384,785 | 5/1983 | Katoh et al. . | |
| 5,329,340 | 7/1994 | Fukuchi et al. . | |
| 5,493,382 | 2/1996 | Takagaki et al. . | |
| 5,570,170 | 10/1996 | Muranyl et al. . | |
| 5,585,899 | 12/1996 | Palumbo et al. . | |
| 5,604,575 | 2/1997 | Takagaki et al. . | |
| 5,826,134 | 10/1998 | Hino et al. | 399/27 |

FOREIGN PATENT DOCUMENTS

| | | | |
|---|---|---|---|
| 195 20 340 A1 | 12/1995 | Germany . | |
| 90-227083 | 11/1990 | Japan | G03G 15/08 |
| 4-80779 | 3/1992 | Japan . | |
| 92-115273 | 4/1992 | Japan | G03G 15/08 |
| 8-137227 | 5/1996 | Japan . | |

OTHER PUBLICATIONS

Patent Abstracts of Japan, P–480, 1986, vol. 10, No. 212. JP61–52 666 A.

Patents Abstracts of Japan. P–1264, 1991, vol. 15, No. 410. JP 3–166 571 A.

Xerox Disclosure Journal, vol. 20, No. 3, 1995, pp. 237 to 240.

*Primary Examiner*—Richard Moses

*Attorney, Agent, or Firm*—Oblon, Spivak, McClelland, Maier & Neustadt, P.C.

[57] ABSTRACT

An electrophotographic image forming apparatus including a developing unit operable with a one- or two-ingredient type developer and a device for replenishing toner to the developing unit included in the apparatus are disclosed. A plurality of toner bottles are accommodated in the toner replenishing device, so that the toner is replenished from one toner bottle to the developing unit. A rotating mechanism causes all the toner bottles to rotate during toner replenishment. A device is provided for determining the frequency of use of the individual toner bottle. The toner discharged from each toner bottle is fed to a toner transport portion via a respective passageway.

40 Claims, 28 Drawing Sheets

20
33
23
30a
30
32
33
23
20
300
23
304
20
323
400
330

IMAGE FORMING APPARATUS AND TONER REPLENISHING DEVICE THEREFOR

BACKGROUND OF THE INVENTION

1. Field of the Invention

The present invention relates to an electrophotographic image forming apparatus including a developing unit operable with a one- or two-ingredient type developer and, more particularly, to a device for replenishing toner to the developing unit.

2. Discussion of the Background

In a copier, printer, facsimile apparatus or similar electrophotographic image forming apparatus, a latent image is electrostatically formed on a photoconductive element or image carrier and then developed by toner fed from a developing unit to turn out a toner image. The toner image is transferred from the photoconductive element to a paper or similar recording medium and then fixed by a fixing unit. Because the toner is sequentially consumed by repeated development, a toner replenishing device replenishes toner to the developing unit in order to make up for the decrease in the toner content of the developer. This allows a preselected toner content to be stably maintained.

For an image forming apparatus of the type consuming a relatively small amount of toner, i.e., Producing a relatively small number of copies, the toner replenishment from the above replenishing device suffices. However, an image forming apparatus of the type producing a relatively great number of copies or often using papers of relatively great sizes consumes a great amount of toner. With this type of apparatus, therefore, it is necessary to replace a toner bottle or cartridge frequently, wasting time and labor.

In light of the above, it has been proposed to increase the capacity, i.e., size of the toner bottle or cartridge. However, an increase in the size of the toner bottle directly translates into an increase in the overall size of the apparatus, and must therefore be restricted. Further, a large size toner bottle is difficult to rotate unless a considerable torque is applied thereto, obstructing toner replenishment. While the rotation of the toner bottle for driving the toner toward its toner outlet may be replaced with a pump or the like, such an alternative scheme increases the cost.

On the other hand, the large size toner bottle or cartridge may be replaced with a plurality of toner bottles or cartridges, as proposed in the past. Japanese Patent Laid-Open Publication No. 2-277083, for example, discloses a toner replenishing mechanism including a toner server accommodating a plurality of toner cartridges. The toner cartridges are automatically switched a plurality of times so as to reduce the frequency of replacement.

Japanese Patent Laid-Open Publication No. 4-115273 teaches an image forming apparatus including a cartridge storing device storing a plurality of toner cartridges. The cartridge storing device automatically feeds toner from a particular one of the cartridges to a toner replenishing device while collecting an emptied toner cartridge. Specifically, after an emptied toner cartridge is retracted from the toner replenishing device, a new toner cartridge is brought to the replenishing device. Subsequently, the empty cartridge is pulled out of the cartridge storing device. With this kind of cartridge storing device, it is possible to continuously feed the toner to the developing unit without interrupting the operation of the apparatus.

However, a problem with the above conventional schemes is that a plurality of toner cartridges are selected at random, preventing the toner server body or the cartridge storing device from having a uniform service life. That is, each cartridge storing portion must be provided with a particular service life and managed independently of the others, resulting in troublesome management. Another problem is that the toner of the cartridge which will be used later looses fluidity and cannot be easily driven toward the mouth of the cartridge at the time of replenishment. This aggravates the amount of toner to be left in the cartridge. In addition, the toner with deteriorated fluidity deposits on the inner wall of the cartridge, further aggravating the amount of toner to be left in the cartridge.

The toner server taught in the above Laid-Open Publication No. 2-277083 must be located next to the developing unit, hindering miniaturization of the apparatus. Moreover, the toner server has a sophisticated structure and cannot be maintained with ease.

SUMMARY OF THE INVENTION

It is therefore an object of the present invention to provide a toner replenishing device including a large capacity toner storing section which is free to lay out, easy to operate, and reliable, and an image forming apparatus including the same.

It is another object of the present invention to provide a toner replenishing device capable of preventing the fluidity of toner stored in toner bottles from being lowered, and an image forming apparatus including the same.

It is another object of the present invention to provide a toner replenishing device not needing a broad space in the vicinity of a developing unit, and preventing the operation efficiency and maintenance efficiency from being lowered, an d an image forming apparatus including the same.

BRIEF DESCRIPTION OF THE DRAWINGS

The above and other objects, features and advantages of the present invention will become apparent from the following detailed description taken with the accompanying drawings in which:

FIGS. 3A-1, 3B-1, 3C-1 and 3D-1 are front views showing a toner bottle included in the first embodiment and how toner is discharged from the bottle;

FIGS. 3A-2, 3B-2, 3C-2 and 3D-2 are sections of FIGS. 3A-1 through 3D-1, respectively;

DESCRIPTION OF THE PREFERRED EMBODIMENTS

Figure 1:
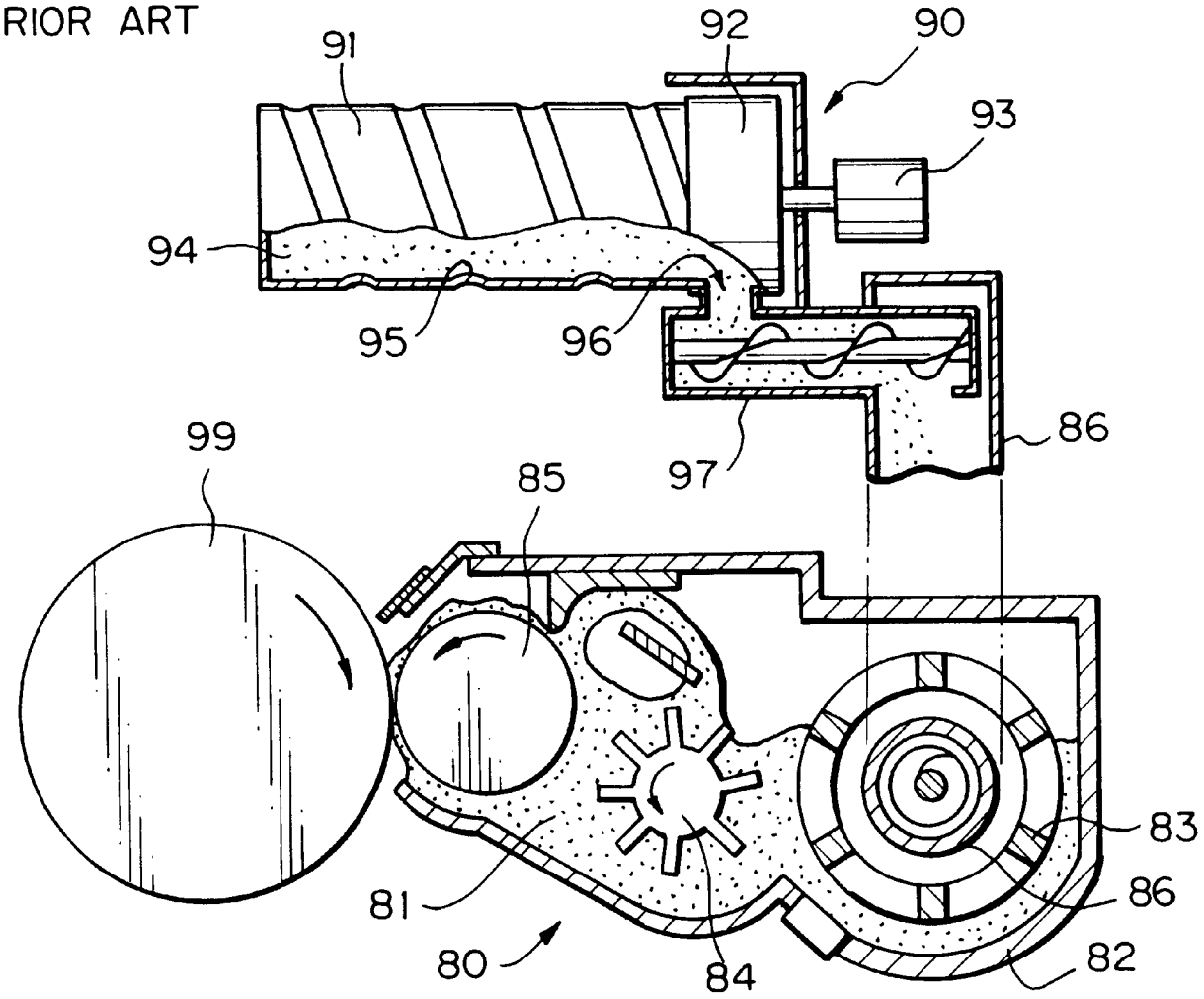
Fig. 1 PRIOR ART
FIG. 1 is a section showing a conventional toner replenishing device and a developing unit including it.

To better understand the present invention, brief reference will be made to a developing unit included in a copier or similar electrophotographic apparatus, and a conventional toner replenishing device associated with the developing unit, shown in FIG. 1. As shown, the developing unit, generally 80, includes a developing box 82 storing a developer 81 which is a mixture of toner 94 and carrier. A first agitating roller 83, a second agitating roller 84 and a developing roller 85 are disposed in the box 82. A pipe 86 for toner replenishment is accommodated in the shaft of the agitating roller 83. The pipe 86 extends out from the box 82 and terminates at a toner replenishing device 90.

The toner replenishing device 90 has a holder 92 for holding a toner bottle or toner container 91, and a motor 93 for rotating the toner bottle 91 and including a decelerator. A spiral ridge 95 is formed on the inner periphery of the toner bottle 91. When the motor 93 with the decelerator rotates the toner bottle 91 held by the holder 92, the toner 94 existing in the bottle 91 is sequentially conveyed toward a toner outlet 96 by the spiral ridge 95 and then transferred to an outlet pipe 97. The toner 94 is replenished into the developing unit 80 via the pipes 97 and 86. In the developing unit 80, t h e agitating rollers 83 and 84 convey the developer 81 to the developing roller 85. The developing roller 85 feeds the developer 81 to a photoconductive element implemented as a drum 99, thereby developing a latent image electrostatically formed on the drum 99.

The problem with the toner replenishing device 90 is that when a great number of copies are produced or when images are reproduced on papers of large size, the consumption of the toner 94 is accelerated and results in frequent and time-consuming replacement of the toner bottle 91, as discussed earlier. Should the capacity of the toner bottle 91 be increased in order to solve the above problem, the apparatus itself would increase in size and would need a great torque for driving the bottle 91. Even replacing the large toner bottles 91 with a plurality of toner bottle and interrupting the operation of the apparatus has the problems stated earlier.

Preferred embodiments of the image forming apparatus and toner replenishing device in accordance with the present invention will be described hereinafter. The image forming apparatus to be described is implemented as a copier by way of example. It is to be noted that particular reference numerals are used in each embodiment, i.e., identical reference numerals used in the embodiments do not always designate identical structural elements.

1st Embodiment

Figure 2:
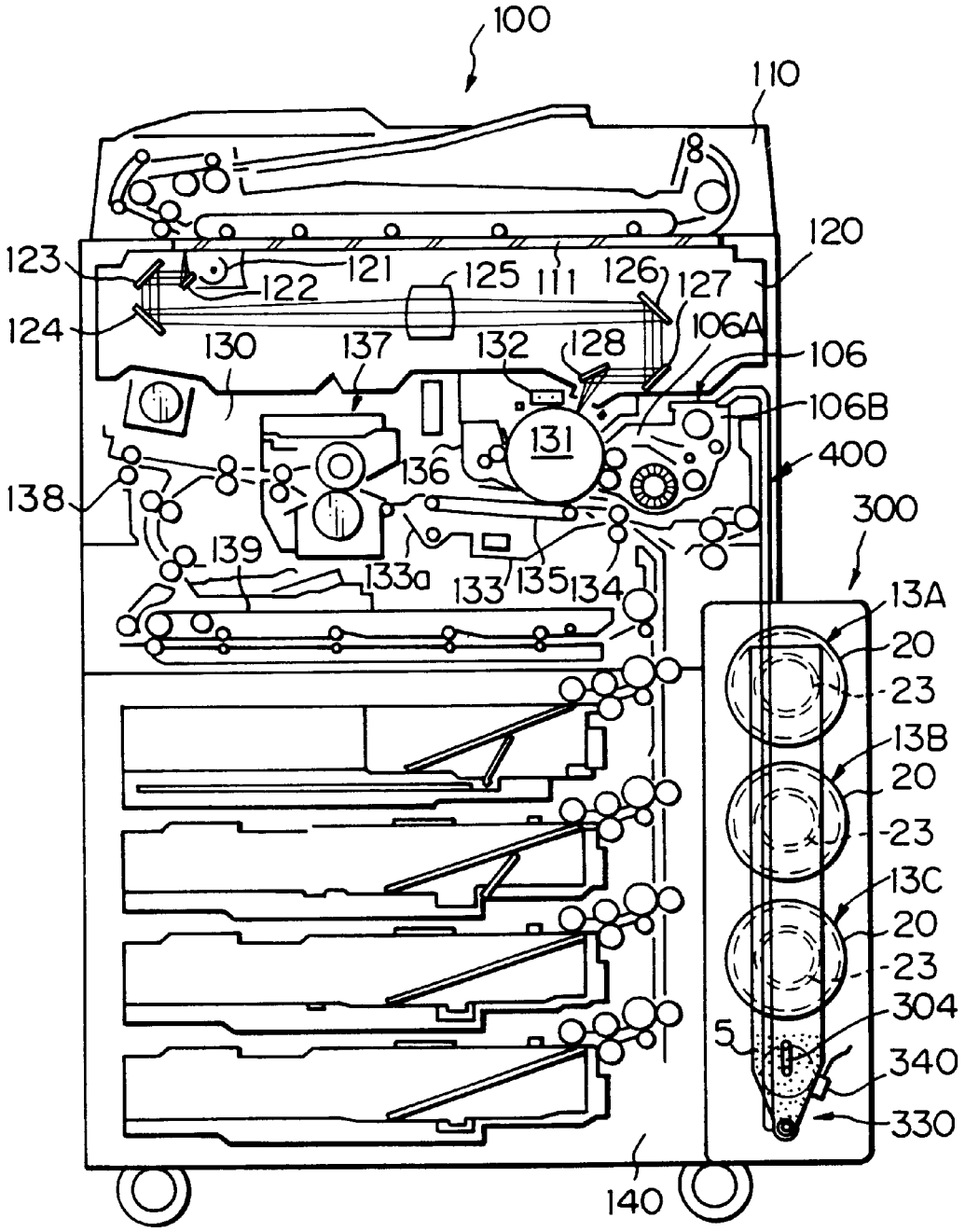
FIG. 2 shows a first embodiment of the image forming apparatus in accordance with the present invention.

Referring to FIG. 2, a copier embodying the present invention is shown and generally designated by the reference numeral 100. As shown, the copier 100 is generally made up of an ADF (Automatic Document Feeder) 110 and an exposing section 120, an image forming section 130 and a paper feeding section 140 cooperating to form images by a conventional electrophotographic process.

The exposing section 120 is implemented by optics including a light source 121, mirrors 122, 123, 124, 126, 127 and 128, and a lens 125. While the light source 121 illuminates a document, not shown, laid on a glass platen 111 by the ADF 110 or by hand, the resulting reflection from the document is propagated through the above optics to a photoconductive drum or image carrier 131 included in the image forming section 130. Arranged around the drum 131 are a charger 132, a developing unit or developing means 106, a registration roller pair 134, an image transfer belt unit 133, a drum cleaning unit 136, a fixing unit 137, an outlet roller 138, and a paper turning section 139 for a duplex copy mode. The paper feeding section 140 includes a plurality of paper cassettes each being loaded with papers of particular size.

In the illustrative embodiment, the exposing section 120 is implemented by an analog exposing system. Alternatively, use may be made of laser optics including a laser and a deflector in order to write an image on the drum 131 optically in response to an image signal, i.e., to implement a laser printer. Further, a document reading device may b e interposed between the ADF 110 and the exposing section 120 so as to construct a digital copier or a facsimile apparatus.

In operation, on the start of image forming operation, the charger 132 uniformly charges the surface of the drum 131. The exposing section 120 exposes the charged surface of the drum 131 imagewise so as to form a latent image representative of a document image. The latent image is developed by a developer (one- or two-ingredient type) stored in the developing unit 106. As a result, the latent image turns out a toner image. The toner image is transferred from the drum 131 to a paper fed from the paper feeding section 140 to the nip between the drum 131 and an image transfer belt 135 via the registration roller pair 134. The paper with the toner image is conveyed lo the fixing unit 137 by the belt 135 included in the image transfer belt unit 133. The fixing unit 137 fixes the toner image on the paper. Thereafter, the paper is driven out onto a tray, not shown, by the outlet roller 138. After the image transfer, the drum cleaning unit 136 removes the toner and paper dust and other impurities left on the drum 131. Also, cleaning means 13*a* included in the image transfer belt unit 133 cleans the belt 135 in order to remove the toner and impurities left thereon.

A flexible pipe 400 provides communication between the developing unit 106 and a toner bark 300 arranged on the outer periphery of the copier 100 and storing toner. The toner is replenished from the toner bank 300 to the developing unit 106 via the pipe 400. The toner bank 300 is a hollow cylindrical container in which a plurality of (three in the embodiment) toner bottles 20 having an identical configuration are arranged sideways one above the other. Each toner bottle 20 has a mouth or toner outlet 23 formed in one end thereof and is positioned with the mouth 23 facing rearward, as viewed in FIG. 2.

Figures 1, 3A:
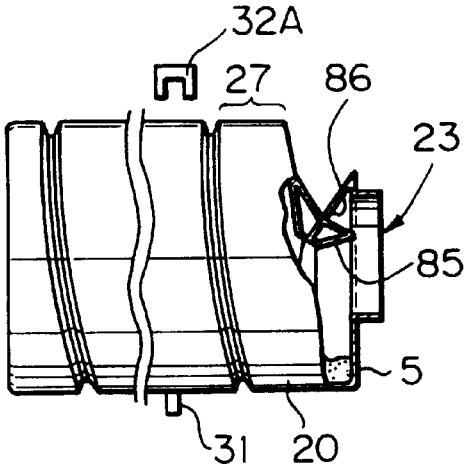
Figures 2, 3A:
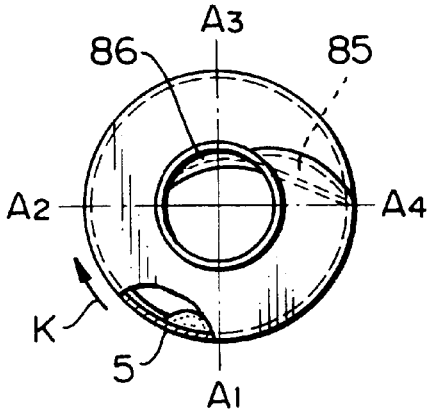

The mouth 23 of each bottle 20 is smaller in diameter than the body of the bottle 20. As shown in FIGS. 3A-1 and 3A-2, the end of each bottle 20 where the mouth 23 is present has its inner periphery partly raised to the edge of the mouth 23, forming a raised portion 85 for lilting the toner. In addition, the above end of the bottle 20 is partly raised along the edge of the mouth 23, forming an inclined raised portion 86 for discharging the toner. Further, as shown in FIG. 4, a cap 7*a* is fitted in the mouth 23 and formed with a lug 7*b* at its center.

Referring again to FIG. 2, the tone, bank 300 includes three holder portions 13A, 13B and 13C respectively accommodating the three toner bottles 20. Because the holder portions 13A-13C are identical in configuration, let the following description concentrate on the: holder portion 13A by way of example.

Figure 4:
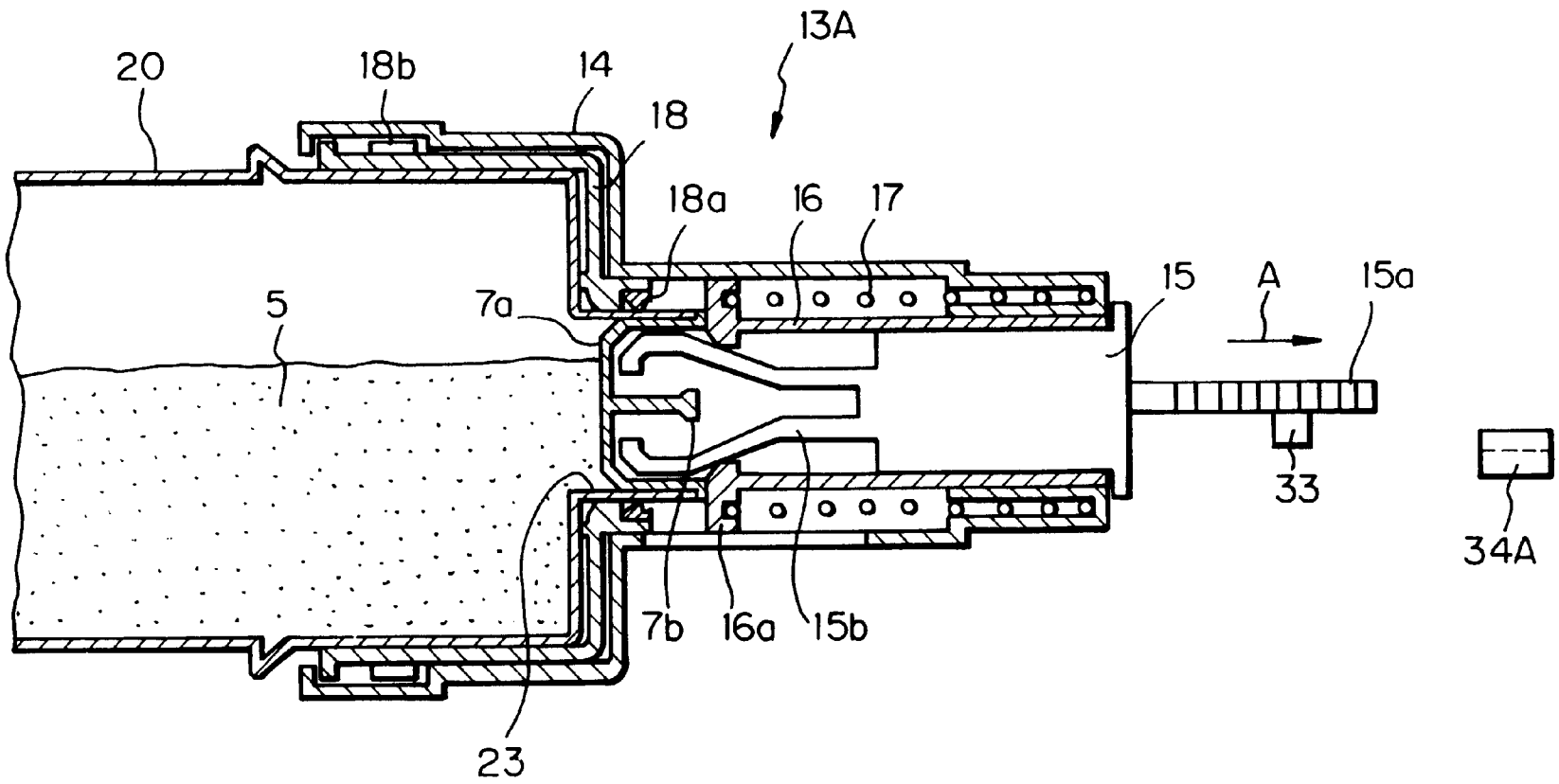
FIGS. 4 and 5 are sections showing a bottle holding mechanism included in the first embodiment.
Figure 5:
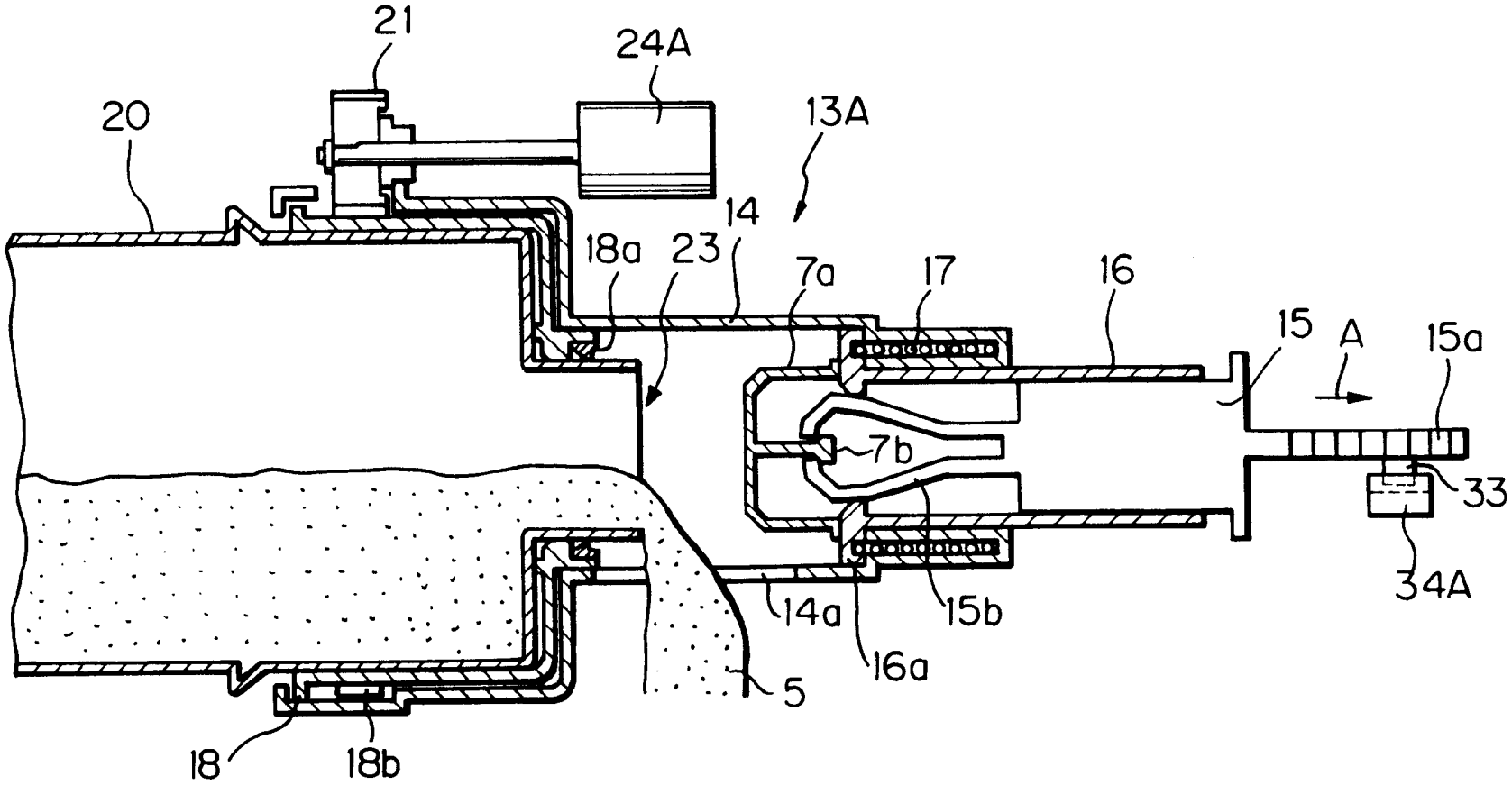
Figure 6:
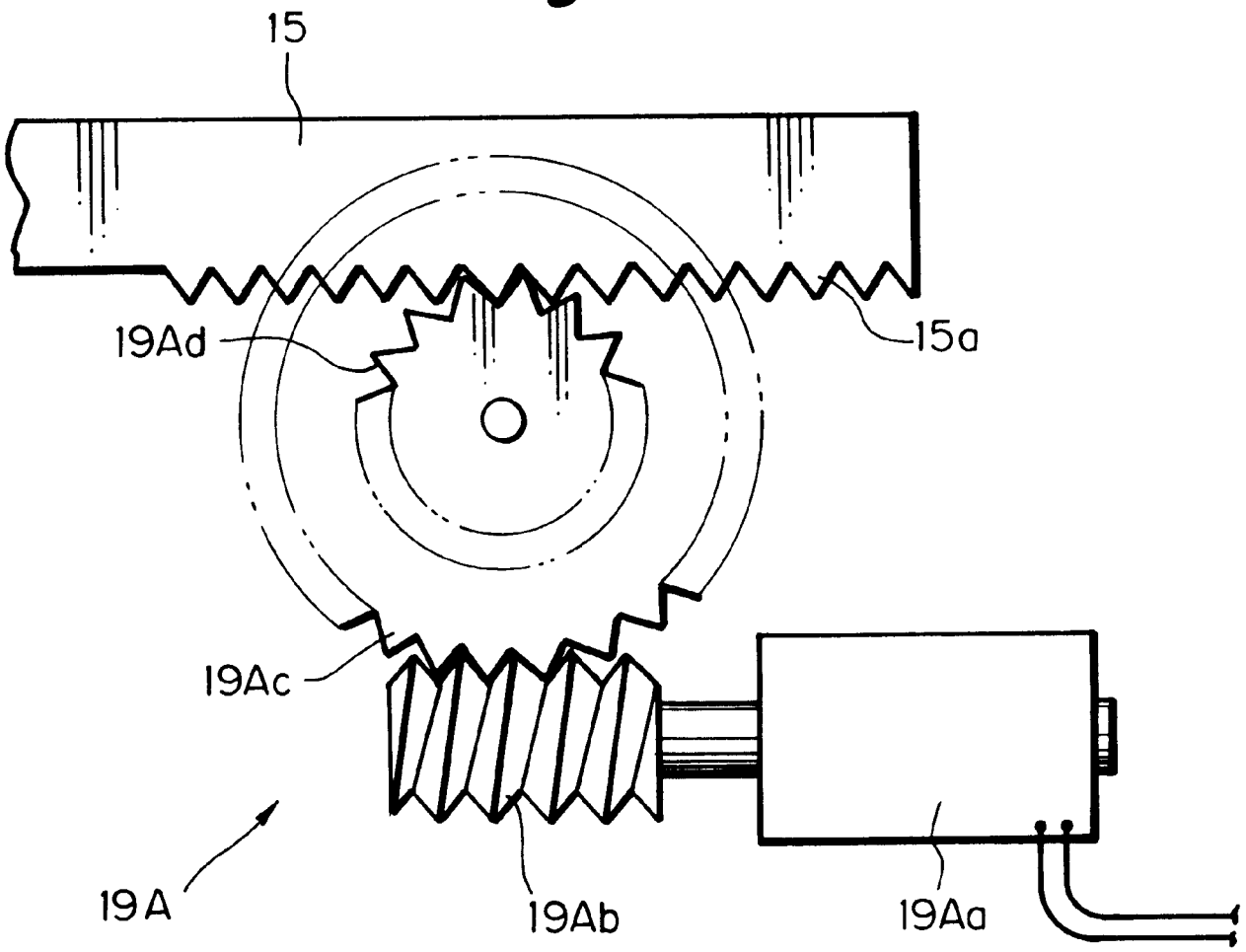
FIG. 6 shows a mechanism included in the first embodiment for removing a cap from the toner bottle.

As shown in FIG. 4, the holder portion 13A has an outer holder 14, a chuck 15, a slider 16, a spring 17, a rotatable inner holder 18, and a moving device 19A (see FIG. 6). The outer holder 14 constitutes the outside wall of the holder portion 13A. The inner holder 18 is received in the outer holder 14 and formed with gear teeth 18*b* on its outer circumferential surface. The inner holder 18 is so configured as to receive a part of the bottle 20 adjoining the end where the mouth 23 is present. As shown in FIG. 5, a drive gear 21 is positioned in the holder portion 13A and held in mesh with the gear teeth 18*b* for driving the inner holder 18. A motor 24A causes the drive gear 21 to rotate under the control of control means 1 which will be described.

A plurality of projections and recesses, not shown, are formed on the outer circumferential surface of the bottle 20, so that the bottle 20 can rotate in synchronism with the inner holder 18. As shown in FIGS. 4 and 5, a seal 18*a* is fitted on the inner holder 18 in order to prevent toner 5 from flying about via the clearance between the bottle 20 and the seat portion of the inner holder 18.

As shown in FIGS. 3A-1, 3B-1, 3C-1 and 3D-1, a lug 31 is studded on the outer circumferential surface of the bottle 20 in the vicinity of the other end of the bottle 20 where the mouth 23 is absent. While the bottle 20 is in rotation, the lug 31 on the bottle 20 is sensed by a sensor 32A mounted on the holder portion 13A. The lug 31 and sensor 32A constitute means for detecting the frequency of use. The output of the senor 32A is sent to the control means 1.

Figures 1, 3B:
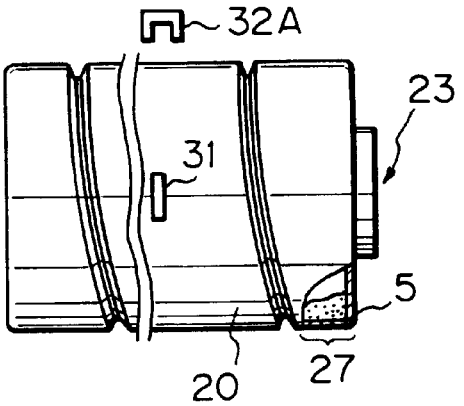
Figures 2, 3B:
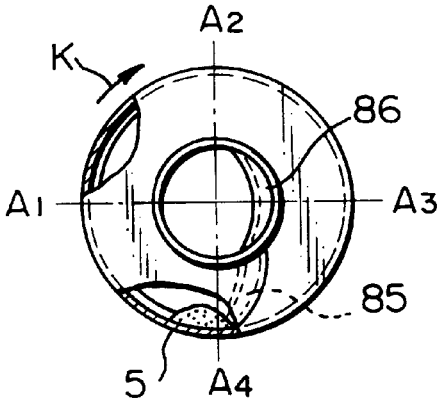

How the toner 5 is discharged from the bottle 20 will be described with reference to FIGS. 3A-1, 3A-2, 3B-1, 3B-2, 3C1, 3C-2, 3D-1 and 3D-2. FIGS. 3A-1, 3B-1, 3C-1 and 3D-1 and FIGS. 3A-2, 3B-2, 3C-2 and 3D-2 are respectively front views and side elevations (as seen from the right) demonstrating how the toner 5 is guided by the raised portions 85 and 86. Consecutive conditions shown in FIGS. 3A-1 through 3D-1 are sequentially shifted by 90 degrees with respect to the rotation of the bottle 20. An arrow K indicates the direction of rotation of the bottle 20.

First, as shown in FIGS. 3A-1 and 3A-2, the largest diameter portion of the shoulder of the bottle 20 is positioned at the bottom, so that the toner 5 is guided by a guide groove 27 to the bottom of the inner periphery of the above portion of the bottle 20. As shown in FIGS. 3B-1 and 3B-2, when the bottle 20 is rotated by 90 degrees in the direction K, the border between the largest diameter portion and the raised portion 85 is brought to the bottom. As a result, the toner 5 guided by the guide groove 27 partly gets on the raised portion 85. While the bottle 20 is rotated by another 90 degrees in the direction K to the position shown in FIGS. 3C-1 and 3C-2, the raised portion 85 lifts the toner 5 to the edge of the toner outlet 23 like a spoon. About the time when the bottle 20 reaches the position shown in FIGS. 3D-1 and 3D-2 after another 90 degrees rotation, the toner on the raised portion 85 is partly transferred to the inclined raised portion 86 and then discharged via the mouth 23 due to the inclination of the raised portion 86.

Figures 1, 3C:
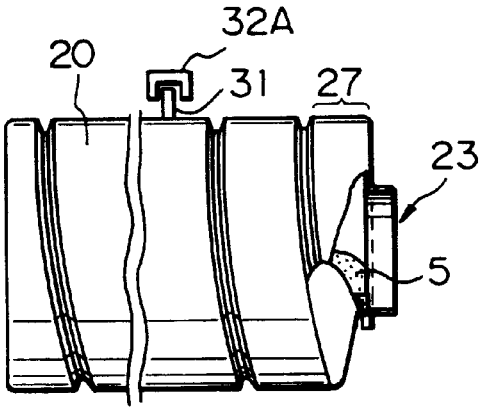
Figures 2, 3C:
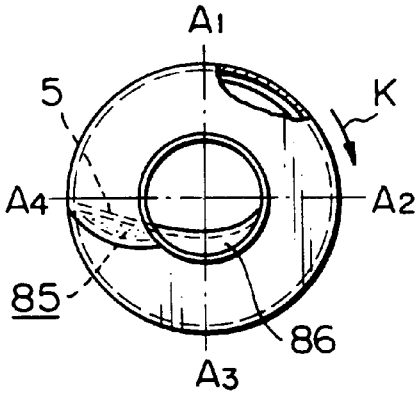
Figures 1, 3D:
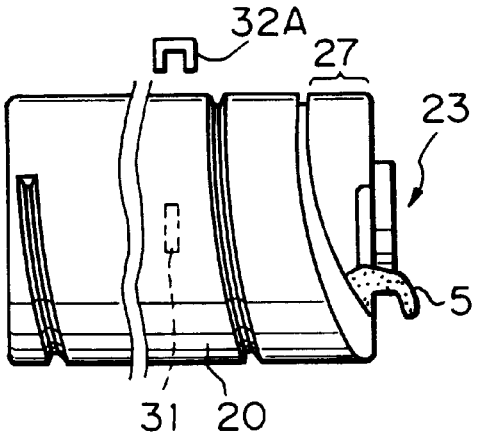
Figures 2, 3D:
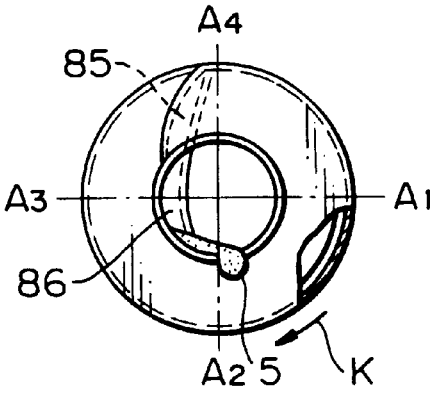

As FIGS. 3C-1 and 3C-2 indicate, the raised portion 86 also resembles a spoon. With this configuration of the portion of the bottle 20 adjoining the mouth 2.3, it is possible to prevent the toner 5 from dropping from the outlet 23 in a mass, i.e., to allow the toner to be discharged little by little without flying about in a hopper formed in the lower portion of the toner bank 300. Also, it is possible to use substantially the entire toner 5 existing in the bottle 20. In addition, when the bottle 20 is rotated, a so-to-speak spoonful of toner is lifted to the mouth 23 with an excessive part of the toner removed. This allows the toner 5 to be discharged via the mouth 23 in a constant amount.

As shown in FIG. 4, a mechanism for fitting and removing the cap 7*a* from the mouth 23 is arranged at the rear in the direction of insertion of the bottle 20. The mechanism mainly consists of the chuck 15, slider 16, spring 17, and moving device 19A mentioned earlier. The slider 16 is slidably received in the holder 14 and made up of a hollow cylindrical body and a pressing portion 16*a* having an inside diameter smaller than the body and an outside diameter larger than the body. The spring 17 surrounds the body of the slider 16 and constantly biases it to the left, as viewed in FIG. 4. When the bottle 20 with the cap 7*a* is inserted into the holder 18, the pressing portion 16*a* presses the cap 7*a* toward the mouth 23.

The chuck 15 is slidably received in the body of the slider 16. The chuck 15 is made up of a cylindrical body whose outside diameter is slightly smaller than the inside diameter of the slider 16, a rack 15*a* formed integrally with the end of the body remote from the bottle 20, and a flexible nip portion 15*b* formed integrally with the end of the body close to the bottle 20. The nip portion 153 protrudes toward the cap 7*a* over the inside diameter of the pressing portion 16*a* and flared radially outward, as illustrated. The rack 15*a* is connected to the moving device 19A which will b e described. The chuck 15 is movable in the direction indicated by an arrow A by being driven by the moving device 19A. A lug 33 is studded on the rack 15*a* while a sensor 34A is mounted on the holder portion 13A. When the chuck 15 is moved in the direction A by the moving device 19A until the cap 7*a* has been removed from the mouth 23, the lug 33 is sensed by the sensor 34A. The lug 33 and sensor 34A constitute counting means. After the sensor 34A has sensed the lug 33, it outputs a signal when the lug 33 is again brought out of its sensing range, i.e., when the chuck 15 is moved in the direction opposite to the direction A. The output of the sensor 34A is sent to the control means 1.

As shown in FIG. 6, the moving device 19A mainly consists of a motor 19A*a*, a worm 19A*b* mounted on the output shaft of the motor 19A*a*, a worm wheel (or bevel gear) 19A*c* held in mesh with the worm 19A*b*, and a pinion gear 19A*d* coaxial with the worm wheel 19A and held in mesh with the rack 15*a*. When the motor 19A*a* is driven clockwise or counterclockwise by the control means 1, it moves the chuck 15 in the right-and-left direction so as to fit or remove the cap 7*a* in or from the mouth 23.

Figure 7:
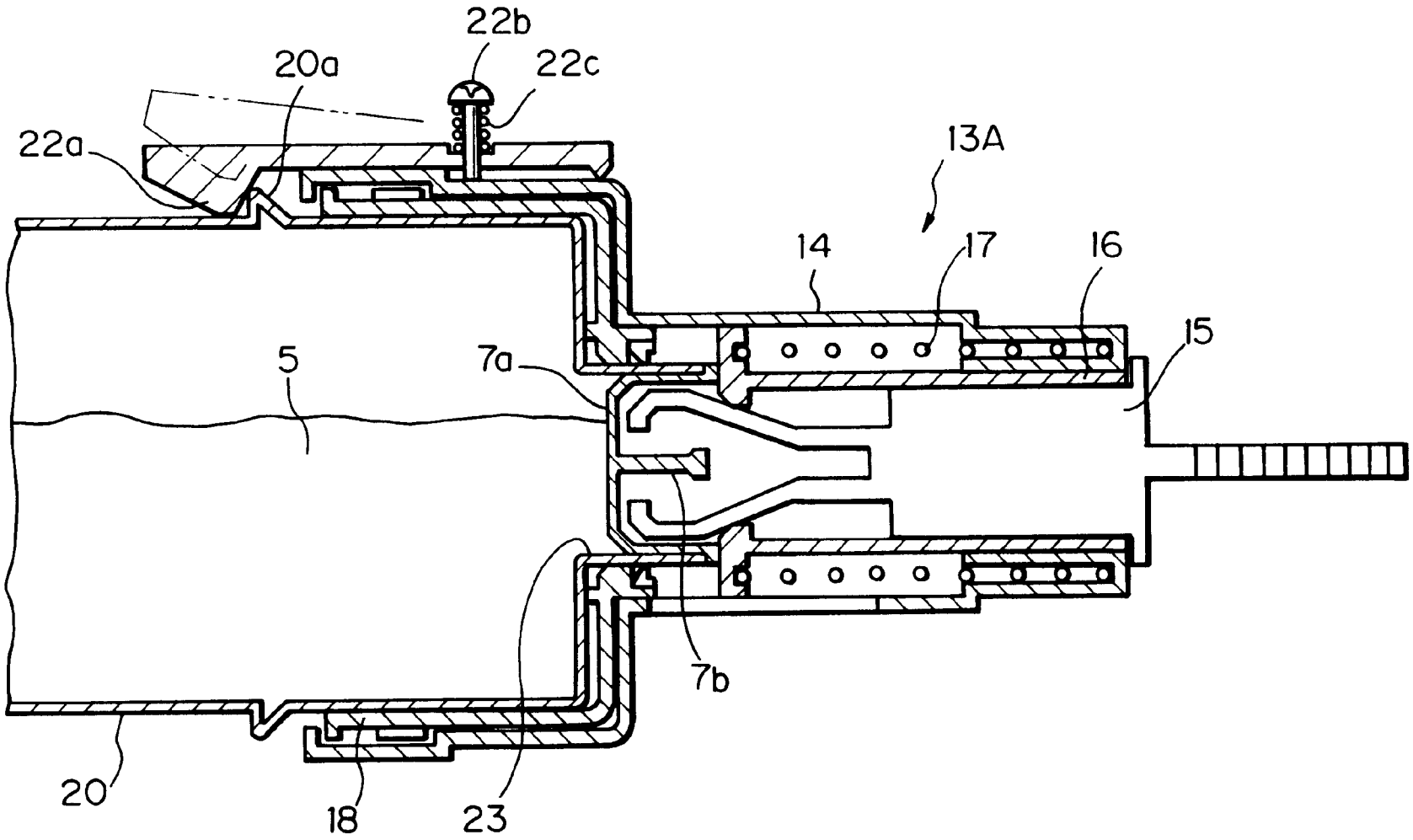
FIG. 7 is a section showing a stop provided on the toner bottle.

As shown in FIG. 7, a stop 22*a* is positioned outside of the holder 14, i.e., at the side of the holder portion 13A adjoining the inside of the copier 100. The stop 22*a* stops the bottle 20 tending to move backward due to the bias of the spring 17 when the cap 7*a* is inserted into the mouth 23. A lug 20*a* is formed on the outer circumferential surface of the bottle 20. The stop 22*a* is supported by a stepped screw 22*b* and a spring 22*c* affixed to the holder 14. The stop 22*a* has a hook at its end which is engageable with the lug 20*a*. The force of the spring 22*c* is selected to be greater than the force of the spring 17. This prevents, when the cap 7*a* plugs the mouth 23, the stop 22*a* from rising to a position indicated by a dash-and-dots line in FIG. 7. Because the bottle 20 is retained by the stop 22*a* during fitting of the cap 7*a*, the cap 7*a* can be surely fitted in the mouth 23. The bottle 20 can be replaced only if it is pulled out more strongly or if it is retracted to the dash-and-dots line position by finger or by; a lever or the like which may be added to the above arrangement.

As stated above, three toner bottles 20 are respectively received in three holder portions 13A–13C formed in the toner bank 300. The holder portions 13A–13C each is provided with the respective cap removing mechanism and bottle rotating mechanism. Therefore, each bottle 20 can be plugged and unplugged independently of the others. This allows a system in which the toner 5 is replenished from the plurality of bottles 20 and a system in which the bottles 20 are sequentially used one by one up to the toner end condition to be selectively used.

Referring again to FIG. 2, the toner 5 discharged from any one of the bottles 20 drops to a toner transport path formed at the bottom of the toner bank 300. If the toner 5 is fed from the bottle 20 in an excessive amount, there will occur toner blocking due to the pressure of the toner 5, deteriorating conveyance. In light of this, a toner height sensor 340 responsive to the height of the toner 5 is positioned in the lower portion of the Toner bank 300. The operation for plugging and unplugging the bottle 20 is controlled on the basis of the output of the above sensor 340, so that the toner 5 is prevented from being replenished to a height above a preselected height. The output of the sensor 340 is also sent to the control means 1.

Figure 8:
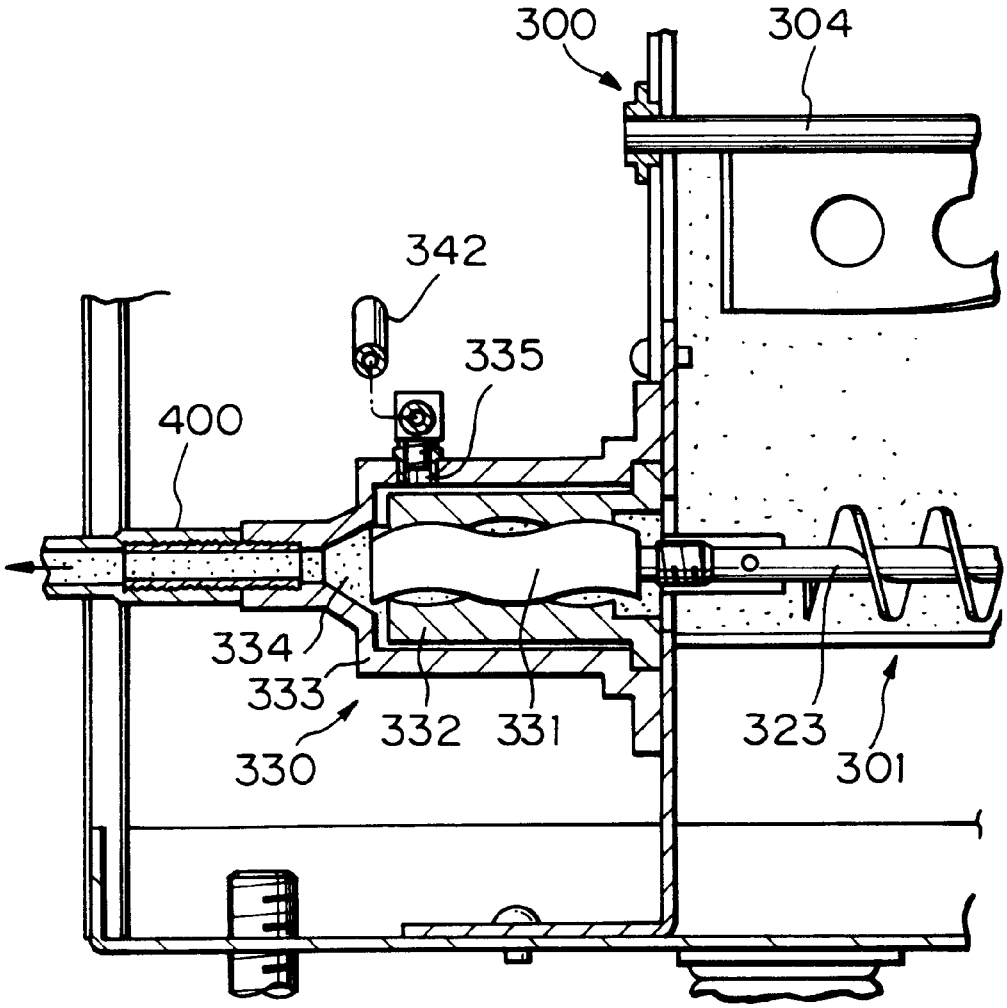
FIG. 8 is a section of a powder pump constituting toner conveying means included in the first embodiment.

A powder pump unit 330 is disposed in the above toner transport path. As shown in FIG. 8, the powder pump unit 330 is implemented as a so-called Morno pump mainly consisting of a rotor 331, a stator 332, and a holder 333. The rotor 331 is connected to a motor or similar drive source, not shown, by a drive shaft or a horizontal screw conveyor 323. Specifically, the powder pump unit 330 has the rotor 331 connected to the drive source by the horizontal screw conveyor 323, the stationary stator 332 surrounding the rotor 331, and the holder 333 holding the stator 332. The toner 5 existing in the lower portion of the toner bank 300 is introduced into the pump 330 from the screw 323 side and then conveyed by the rotor 331 toward a passageway 334.

A gap of about 1 mm exists between the side of the stator 332 and the side of the holder 3333 facing it and is communicated to the passageway 334. An air pump, not shown, has its outlet communicated to the passageway 334 via a piping 342 and an air inlet port 335 formed in the holder 333, so that air is blown into the passageway 334 via the above gap. The air pump is so conditioned as to blow air into the toner 5 existing in the passageway 334 at a rate of 0.5 litter to 1 litter per minute. The resulting stream of air promotes the fluidity of the toner 5 and allows the toner 5 to be discharged to the flexible pipe 400 while being mixed with air. The toner can therefore be conveyed more positively in the powder pump unit 330.

As shown in FIG. 2, the toner 4 coming out of the powder pump unit 330 is delivered via the pipe 400 to a toner replenishing section 106B, which will be described, formed in the developing unit 106. The flexible pipe 400 should preferably be formed of a material highly resistant to toner, e.g., soft vinyl chloride, Nylon, Teflon, or ethylene tetrafluoride. Such flexible connection between the developing unit 106 and the toner bank 300 allows each of them to be efficiently laid out and allows the toner bank 300 to be increased in size. The pipe 400 and powder pump unit 330 constitute toner conveying means. The operation of the powder pump unit 330 is also controlled by the control means 1.

Figure 9:
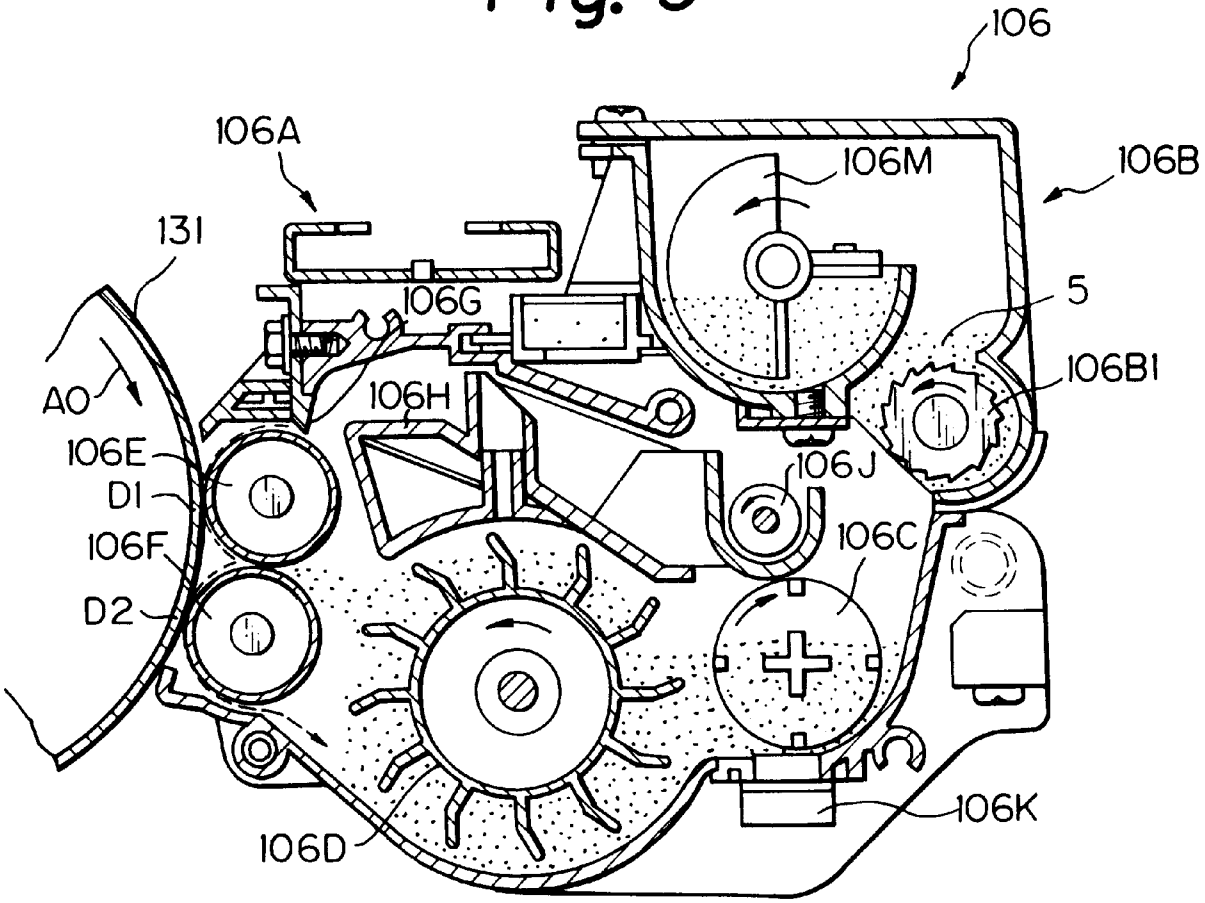
FIG. 9 is a section showing a developing unit applicable to the first embodiment.

In the illustrative embodiment, the developing unit 106 is based on magnet brush development using a toner and carrier mixture or two-ingredient type developer. As shown in FIG. 9, the developing unit 106 is made up of a casing 106A and the toner replenishing section 106B mentioned earlier. The casing 106A adjoins the drum 131 rotatable in the direction indicated by an arrow A0 while the toner replenishing section 106B is mounted on the casing 106A.

An agitating roller 106C and a paddle wheel 106D are disposed in the casing 106A. The agitating roller 106C mixes the magnetic or nonmagnetic toner 5 and magnetic carrier and thereby charges either have the same polarity or opposite polarities. The paddle wheel 106D scoops up the charged toner and carrier mixture. A replenishing roller 106B1 is disposed in the toner replenishing section 106B. When the toner content of the toner and carrier mixture to be fed to the drum 131 decreases, the replenishing roller 106B1 is rotated to replenish the toner 5 toward the agitating roller 106C under the control of the control means 1.

A plurality of (two in the embodiment) developing rollers 106E and 106F are positioned in the vicinity of the drum 131 such that the developer scooped up by the paddle wheel 106D reaches the rollers 106E and 106F. The developing rollers 106E and 106F are positioned parallel to each other in the direction A0. Specifically, the first developing roller 106E is positioned upstream of the second developing roller 106F in the direction A0. The developing rollers 106E and 106F each has a sleeve driven by drive means, not shown, to rotate counterclockwise as viewed in FIG. 9, and a magnet roller fixed in place within the sleeve. The sleeve is formed of aluminum, stainless steel or similar nonmagnetic material while the magnet roller is implemented by, e.g., a ferrite magnet, a rubber magnet, or a plastic magnet formed of a mixture of Nylon powder and ferrite powder. The magnet has a plurality of poles arranged on its circumference.

The paddle wheel 106D in rotation scoops up the developer due to a centrifugal force and releases it toward the first developing roller 106E. A part cf this developer is directly deposited on the developing roller 106E. The other part of the developer rebounds on hitting against the second developing roller 106F and is deposited on the first developing roller 106E by magnetic attraction. To feed the developer from the roller 106F to the roller 106E, it is necessary that the rotational speed of the paddle wheel 106D, i.e., the centrifugal force be high enough to enhance the rebound of the developer from the roller 106F.

The developer deposited on the developing roller 106E is conveyed by the roller 106E to a first developing position D1 where the roller 106E faces the drum 131, while being regulated in thickness by a doctor blade 106G. At the developing position D1, the toner 5 contained in the developer develops a latent image carried on the drum 131 and thereby produces a corresponding toner image. The developer moved away from the developing position D1 reaches a position where the magnetic force of the developing roller 106E is weak. As a result, the developer is conveyed to a second developing position D2 where the second developing roller 106F faces the drum due to the rotation of the roller 106F and the force of the magnet roller of the roller 106F, as indicated by a dashed line in FIG. 9. At a position where the magnetic force of the developing roller 106F does not act, the developer drops to the bottom of the casing 10 and is again agitated by the paddle wheel 106D.

On the other hand, the developer removed from the first developing roller 106E by the doctor blade 106G is guided by a separator 106H toward a screw conveyor 106J located at the other end of the separator 1066H. The screw conveyor 106J causes the developer to drop onto the agitating roller 106C while distributing it therealong. For this purpose, a slit for dropping the developer is formed in the above end of the separator 106H and faces the agitating roller 106C.

The magnet rollers of the two developing rollers 106E and 106F are magnetized such that the same poles thereof form a repulsing magnetic field at a position where the rollers 106E and 106F are closest to each other. This magnetic field forces the developer to move from the developing roller 106E toward the developing roller 106F.

A toner content sensor 106K is mounted on the casing 106A in the vicinity of the agitating roller 106C so as to sense the toner content or toner and carrier mixture ratio of t h e developer. For example, the sensor 106K may sense the toner content of the developer on the basis of the variation of the inductance of a coil disposed in the developer. When the toner content of the developer in the casing 106A decreases, the sensor 106K sends its output to the control means 1.

Figure 10:
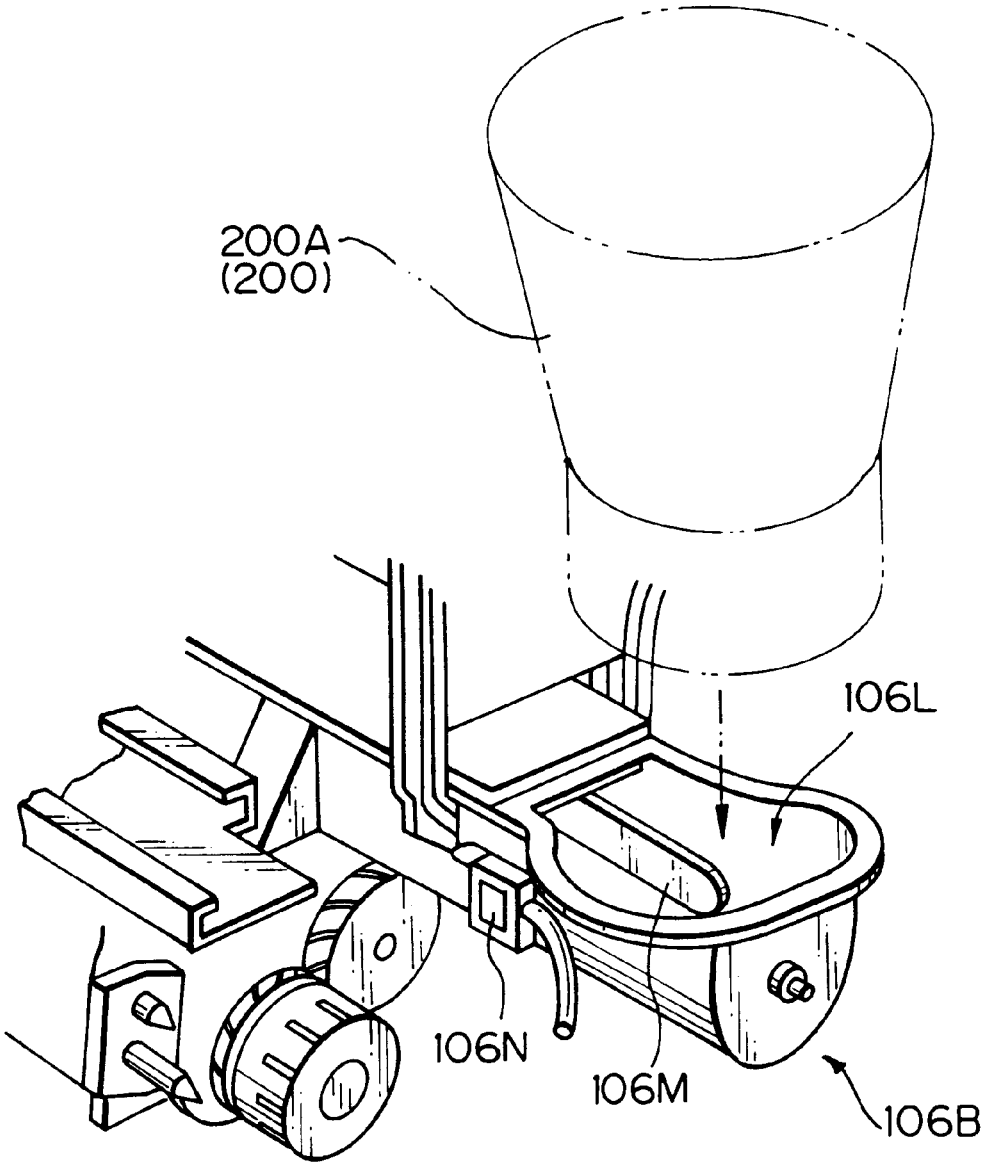
FIG. 10 is a perspective view showing a toner replenishing section included in the developing unit.

FIG. 10 shows an agitating member 106M disposed in the toner replenishing section 106B specifically. As shown, the replenishing section 106B is formed with an opening 106L for replenishment at its one end in the axial direction of the agitating member 106M. Toner collecting means 200 is implemented as a unit independent of the developing unit 106 and removably fitted in the opening 106L. The toner collecting means 200 collects the toner 5 transferred from the toner bank 300 via the pipe 400 by separating it from air. Upon a decrease of the toner 5 to be replenished, the collecting means 200 replenishes the toner 5 received from the toner bank 300.

Figure 11:
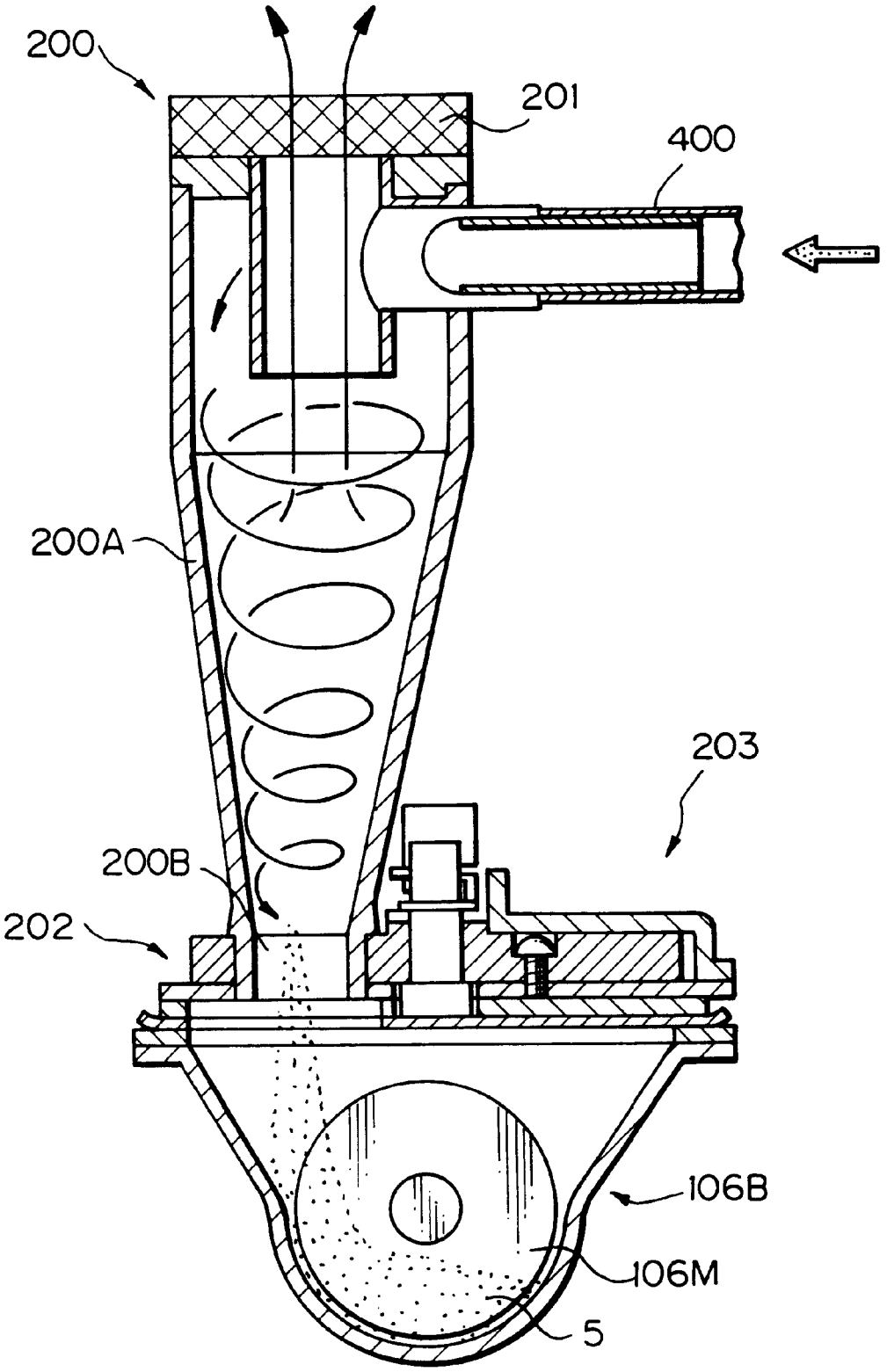
FIG. 11 is a section showing the toner replenishing section and toner collecting means included in the developing unit.

Specifically, as shown in FIG. 11, the toner collecting means 200 has a vertically long funnel-like separating section 200A. When the toner 5 fed under pressure from the toner bank 300 together with air is introduced into the separating section 200A, the separating section 200A separates the toner 5 from air and causes it to drop into the toner replenishing section 106B due to gravity. One end of the pipe 400 is connected to the upper portion of the separating section 200A while an opening 200B is formed in the bottom of the separating section 200A and communicable to the toner replenishing section 106B. When the toner and air mixture coming in through the pipe 400 hits against the inner periphery of the separating section 200A, it flows spirally due to the relation between the shape of the separating section 200A and the position of the pipe 400. As a result, the toner having a great specific gravity falls while air having a small specific gravity rises. This successfully separates the toner 5 from air conveying it. A filter 201 capable of passing only air therethrough is fitted on the top of the separating section 200A. A member 202 for blocking and unblocking the opening 200B at the time of, e.g., maintenance and a mechanism 203 for moving it are arranged on the bottom of the separating section 200A.

As shown in FIG. 10, a residual loner sensor 106N is mounted on the lower portion of the toner replenishing section 106B and implemented by a piezoelectric device. This sensor 106N determines the amount of toner remaining in the replenishing section 106B in terms of the pressure of the toner 5. When the toner 5 in the replenishing section 106B decreases below a preselected amount, the sensor 106N sends its output to the control means 1.

Figure 12:
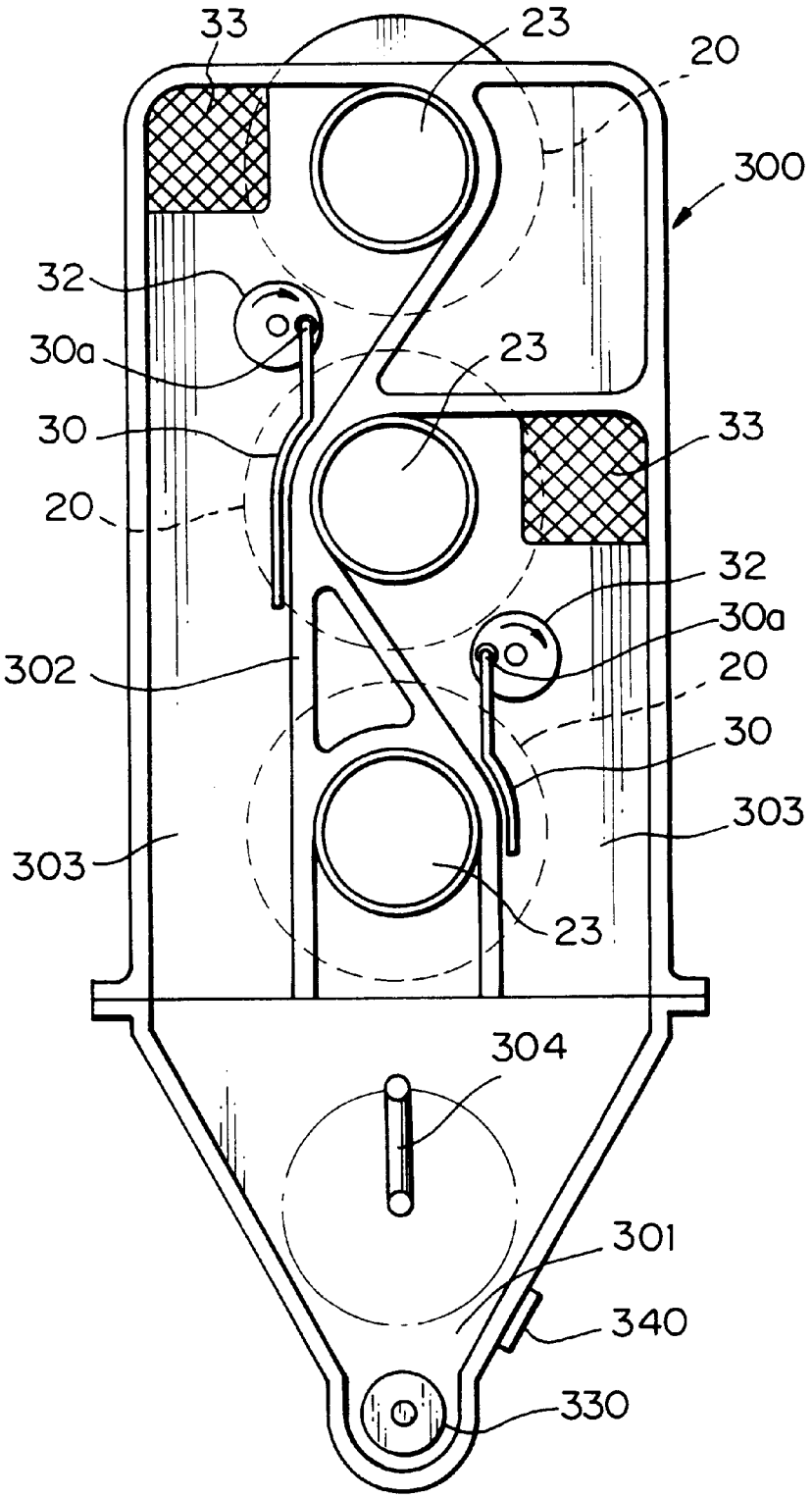
FIG. 12 is a front view of a toner bank included in the first embodiment.

The bottles 20 are positioned one alcove the other within the toner bank 300 in order to reduce the width of the toner bank 300. This, however, brings about a problem in that the toner discharged from the overlying bottle 20 is apt to smear the mouth 23 of the underlying bottle 20 and fly about at the time of replacement of the underlying bottle 20. In light of this, as shown in FIG. 12, a partition member 302 forms a passageway 303 extending toward a toner transport path 301. The partition member 302 surely prevents the toner discharged from the overlying bottle 20 from smearing the mouth 23 of the underlying bottle 20. It follows that the operator's hands and cloths are free from smears ascribable to the toner at the time of replacement of the underlying bottle 20.

Figure 13:
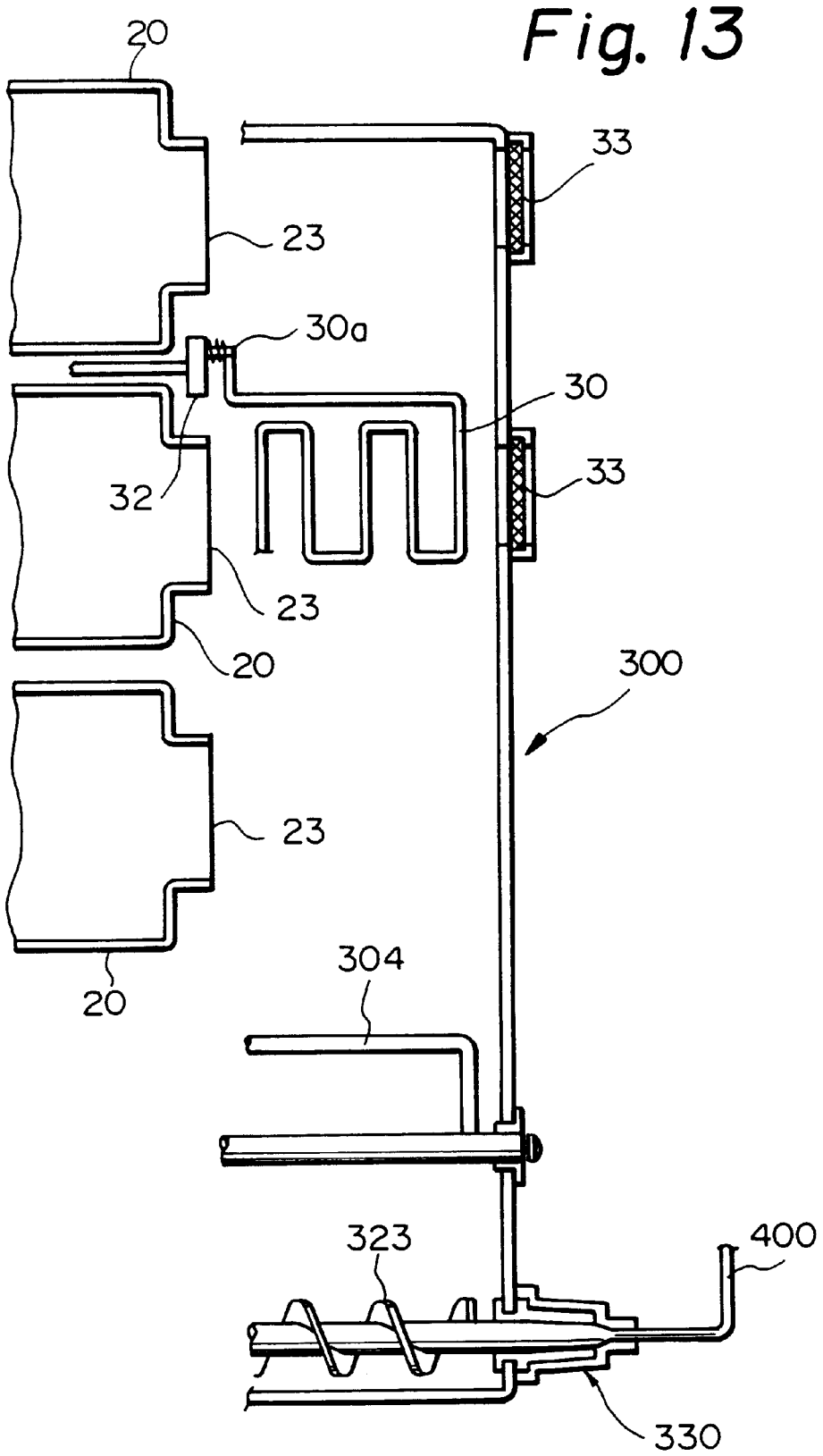
FIG. 13 is a side elevational view of the toner bank.

The passageway 303 formed by the partition member 302 is apt to cause the toner to stay and form bridges before reaching the toner transport path 301. This part of the toner is likely to block the toner transport path 303. Particularly, the toner is apt to form bridges at the corners of the passageway 303. To solve this problem, is shown in FIGS. 12 and 13, wires or similar anti-bridge members 30 are located at suitable positions in the passageway 303. The anti-bridge members 30 each is anchored to a pin 30*a* studded on a disk 32 which is rotatable in interlocked relation to the drive gear 21, FIG. 5. The anti-bridge members 30 are therefore movable in the up-and-down direction and right-and-left direction at the time of replenishment from the bottle 20.

The toner is apt to fly about and circulate in the toner bank 300 due to the rotation of the bottles 20 and that of the anti-bridge members 30. To reduce such movement of the toner, vent portions 33 are formed in the upper part of the toner bank 300. The vent portions 33 are implemented by replaceable filters capable of filtering out the toner 5 by passing air therethrough.

Figure 14:
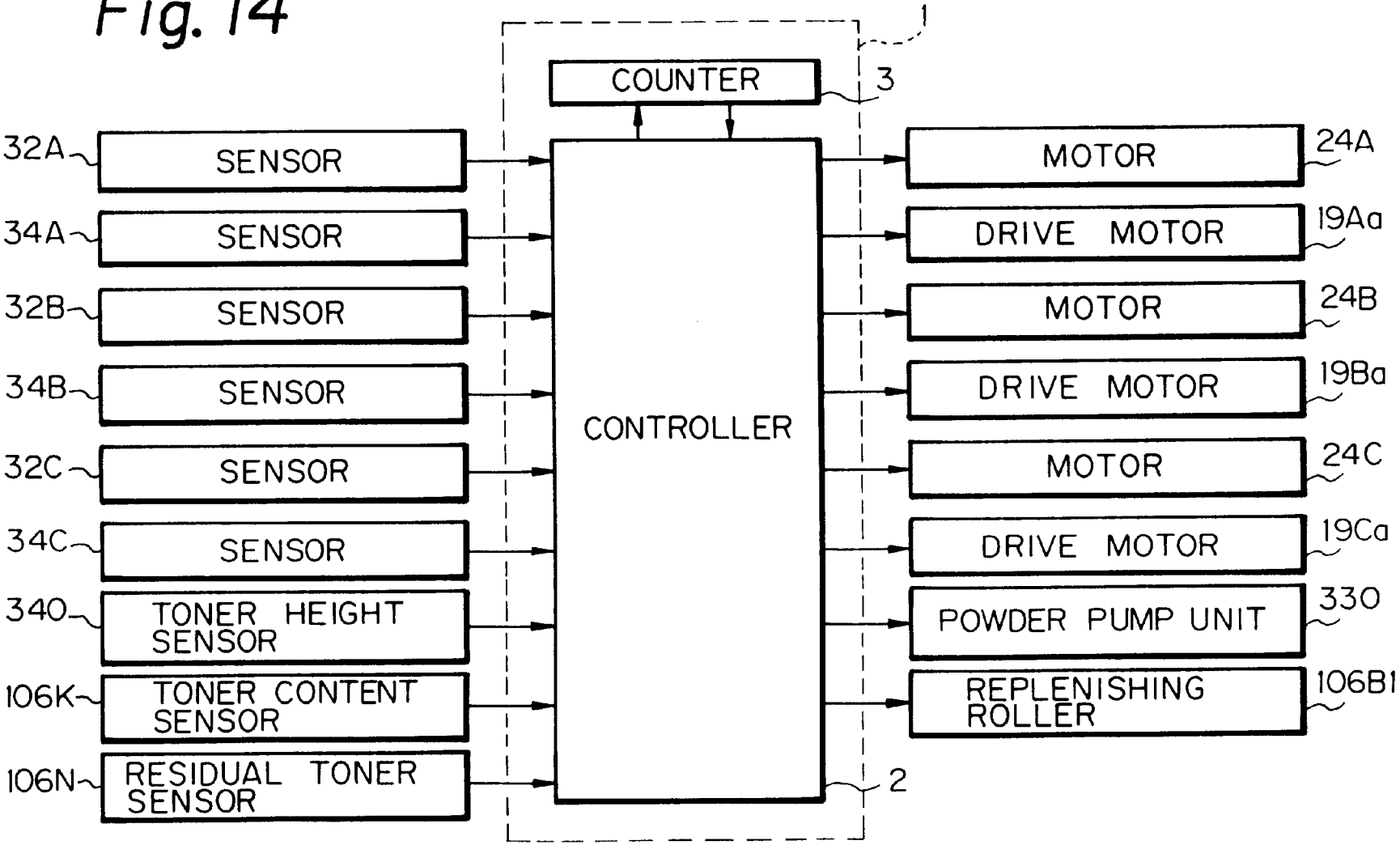
FIG. 14 is a block diagram schematically showing a control system included in the first embodiment.

Referring to FIG. 14, a control system included in the illustrative embodiment will be described. As shown, t h e control system includes the control means 1 implemented by a conventional microcomputer having a CPU (Central Processing Unit), a ROM (Read Only Memory), a RAM (Random Access Memory) and so forth, although not shown specifically. The control means 1 has a controller 2 and a counter 3. The controller 2 receives the outputs of the various sensors while sending control signals to the various drive members. The counter 3 counts, holder by holder (13A–13C), the outputs of the sensor included in the sensing means responsive to the frequency of use and the sensor included in the counting means. sensors 32B and 32C identical with the sensor 32A, sensors 34B and 34C identical with the sensor 34A, motors 24B and 24C identical with the motor 24A and motors 19B*a* and 19C*a* identical with the motor 19A*a* are respectively assigned to the holders 13B and 13C and also connected to the control means 1.

In response to the outputs of the sensors 32A–34C, toner height sensor 340, toner content sensor 106K and residual toner sensor 106N, the control means 1 sends control signals to the motors 24A–24C, motors 19A*a*–19C*a*, powder pump unit 330, and replenishing roller 106B1.

The operation for replenishing the toner 5 will be described hereinafter. A latent image formed on the drum 131 is developed by the two developing rollers 106E and 106F of the developing unit 106, consuming the toner 5 of the developer. When the toner content of the developer in the casing 106A decreases due to the consumption, the toner content sensor 106K sends its output to the control means 1. In response, the control means 1 causes the replenishing roller 106B1 to rotate so as to replenish the toner 5 from the toner replenishing section 106B. When the developer in the casing 106 recovers its preselected toner content, the control means 1 stops the rotation of the roller 106B 1 in response to the resulting output of the sensor 106K.

When the toner existing in the toner replenishing section 106B decreases below a preselected amount due to the operation of the replenishing roller 106B1, the control means 1 drives the powder pump unit 330 in response to the output of the residual toner sensor 106N. As a result, the powder pump unit 330 feeds the toner 5 from the lower portion of the toner bank 300 to the replenishing section 106B. When the toner in the replenishing section 106B increases above the preselected amount, the control means 1 stops driving the powder pump unit 330 in response to the output of the residual toner sensor 106N. In this manner, the amount of toner in the replenishing section 106B is maintained constant, insuring toner replenishment to the developing unit 106A.

A first specific procedure for replenishing the toner 5 from the plurality of toner bottles 20 evenly is as follows. The residual toner sensor 106N determines how many times it has detected a decrease in the amount of toner in the replenishing section 106B below the preselected amount, and compares it with a reference value. When the number of times determined coincides with the reference value, the sensor 106N sends its output to the control means 1, determining that the toner 5 is absent in the lower portion of the toner bank 300. In response, the control means 1 scans the counter 3 storing the number of outputs of each of the sensors 32A–32C assigned to the holder portions 13A–13C, respectively. Then, the control means 1 sends a drive signal to one of the holder portions 13A–13C relating to the sensor smaller than the other sensors in the number of outputs counted in the past, or sends it to any one of the holder portions 13A–13C if the numbers of outputs are the same. Initially, the control means 1 sends the drive signal to the holder portion 13A.

In response to the drive signal, the motor 19A*a* assigned to the holder portion 13A causes the chuck 15 to move in the direction A shown in FIG. 4. The chuck 15 nips the lug 7*b* of the cap 7*a* with its flexible nip portion 15*b* and pulls the cap 7*a* out of the bottle 20. When the mouth 23 of the bottle 20 is unplugged, as shown in FIG. 5, the motor 24A is driven to rotate the inner holder 18 via the drive gear 21 with the result that the bottle 20 is rotated together with the inner holder 18. Consequently, the toner 5 is discharged from the bottle 20 via the mouth 23, as stated earlier. How many times the lug 31 crosses the sensor 32A during rotation of the bottle 20 is stored in the counter 3. The toner 5 discharged from the bottle 20 is fed to the lower portion of the toner bank 300. When the toner height sensor 340 determines that the toner 5 has reached a preselected height or amount in the above portion of the toner bank 300, it sends its output to the control means 1. In response, the control means 1 sends a command to the motor 24A for stopping its operation.

Assume that the toner content of the developer in the casing 106A has again decreased due to repeated image formation. Then, the toner 5 is replenished from the toner replenishing section 106B on the basis of the output of the residual toner sensor 106K. Upon the decrease of the toner 5 in the replenishing section 106B below the preselected amount, the toner 5 in the lower portion of the toner bank 300 is fed to the replenishing section 106B on the basis of the output of the residual toner sensor 106N. When the toner 5 is determined to be absent in the lower portion of the toner tank 300, the toner 5 is fed from one of the holder portions 13A2 13C. At this instant, because the counter 3 has already counted the output of the sensor 32A, he control means 1 sends a drive signal to either one of the other holder portions 13B and 13C.

Assume that the control means 1 selects the holder portion 13B by way of example. Then, the motor 19B*a* is driven to remove the cap 7*a* from the bottle 20 held by the holder portion 13B. Then, the motor 24B is driven to discharge the toner 5 from the bottle 20. Again, how many times the lug 31 of the bottle 20 crosses the sensor 32B is stored in the counter 3. This is followed by the same procedure as described in relation to the holder portion 13A.

When the toner 5 in the lower portion of the toner bank 300 is consumed due to repeated image formation, the control means 1 sends a drive signal to the holder portion 13C. The operation to follow is the same as the operation described in relation to the holder portions 13A and 13B. In this case, the motors 19C*a* and 24C assigned to the holder portion 13C are operated.

The above procedure is repeated in order to operate the holder portions 13A–13C evenly. This makes uniform the service lives of the holder portions 13A–13C and thereby extends the interval between consecutive toner replacements by three times. In addition, it is possible to manage the toner bank 300 collectively in place of managing the individual holder portion.

When the number of outputs of any one of the sensors 32A–32C stored in the counter 3 coincides with the preselected value, the control means 1 operates one of the motors 19A*a*–19C*a* associated with the above sensor, determining that the bottle 20 has run out of the toner 5. As a result, the motor causes the associated chuck 15 to move in the direction opposite to the direction A, FIG. 5, thereby fitting the cap 7*a* in the mouth 23 of the bottle 20. At the same time, a message showing that the toner bottle. 20 stored in the holder portion selected has run out of the toner 5 appears o n an operation panel, not shown.

In an alternative arrangement, when the toner height sensor 340 does not send its output to the control means 1 even after one of the motors 24A–24C associated with the holder portion selected has been driven for a preselected period of time, the control means 1 deenergizes associated one of the motors 24A–24C, determining that the bottle 20 has been emptied. Then, the control means 1 drives an associated one of the motors 19A*a*–19C*a* in order to fit the cap 7*a* in the mouth 23 of the bottle 20, while displaying the abovementioned message.

If desired, when all the toner bottles 20 are emptied or when all the counts relating to the toner bottles 20 are close to counts representative of an empty condition, the control means 1 may initialize the holder-by-holder counts.

A second specific procedure for replenishing the toner 5 from the plurality of toner bottles 20 evenly is as follows. When the toner 5 is determined to be absent in the lower portion of the toner bank 300, as in the first procedure, the control means 1 scans the counter 3 and sends a drive signal to one of the holder portions 13A–13C relating to the sensor smaller than the other sensors in the number of outputs counted in the past, or sends it to any one of the holder portions 13A–13C if the numbers of outputs are the same, as stated earlier. Initially, the control means 1 sends the drive signal to the holder portion 13A.

In response to the drive signal, the rotor 19A*a* assigned to the holder portion 13A causes the chuck 15 to move in the direction A shown in FIG. 4. The chuck 15 nips the lug 7*b* of the cap 7*a* with its flexible nip portion 15*b* and pulls the cap 7*a* out of the bottle 20, as shown in FIG. 5. At the same time, the lug 33 is sensed by the sensor 34A. Subsequently, the motor 24A is driven to rotate the bottle 20 with the result that the toner 5 is discharged from the bottle 20 via the mouth 23. When the toner height sensor 340 determines that the toner 5 has reached the preselected height or amount in the above portion of the toner bank 300, it sends its output to the control means 1. In response, the control means 1 sends a command to the motor 24A for stopping its operation.

When the toner 5 is determined to be absent in the lower portion of the toner tank 300 due to repeated image formation, the control means 1 sends a drive signal to any one the holder portions 13A–13C.

When the toner height sensor 340 does not send its output to the control means 1 even after one of the motors 24A–24C associated with the holder portion selected has been driven for a preselected period of time, the control means 1 deenergizes associated one of the motors 24A–24C, determining that the bottle 20 has been emptied. Then, the control means 1 drives associated one of the motors 19A*a*–19C*a* in order to fit the cap 7*a* in the mouth 23 of the bottle 20, while displaying the message mentioned earlier. In this case, the sensor 34A responsive to the movement of the chuck 15 sends its output to the control means 1, and the output is counted by the counter 3.

Assume that the toner 5 is again determined to be absent in the lower portion of the toner bank 300 due to repeated image formation. Then, the control means 1 reads the holder-by-holder counts stored in the counter 3 and sends a drive signal to one of the holder portions 13A–13C having the smallest count. In this case, either one of the holders 13B and 13C is selected. This is followed by the replenishment of the toner 5 from the toner bottle 20. While image formation using the this toner bottle 20 is under way, the emptied toner bottle can be replenished with toner.

Assuming that the holder portion 13B is selected, and that the bottle 20 thereof has run out of the toner 5, then, the motor 19B*a* is driven to fit the cap 7*a* in the mouth 23 while the resulting output of the sensor 34B is counted by the counter 3. For the subsequent image formation, the toner 5 is fed from the bottle 20 of the holder portion 13C.

The second procedure described above also makes uniform the service lives of the holder portions 13A–13C and thereby extends the interval between consecutive toner replacements by three times. In addition, it is possible to manage the toner bank 300 collectively in place of managing the individual holder portion.

If desired, when all the bottles 20 are evenly used, the control means 1 may initialize the holder-by-holder counts. This digitizes the counts and thereby promotes easy control.

While the toner bank 300 shown and described has three holder portions 13A–13C each holding the respective bottle 20, it may accommodate any desired number of toner bottles if it is two or more.

A first specific procedure for replenishing, after one bottle 20 has been fully emptied, the toner 5 from another bottle 20 is as follows. When the toner 5 is determined to be absent in the lower portion of the toner bank 300 due to consumption, the control means 1 sends a drive signal to one of the holder portions 13A–13C relating to the sensor smaller than the other sensors in the number of outputs counted in the past, as in the previous procedures. Initially, the control means 1 sends the drive signal to the holder portion 13A.

In response to the drive signal, the motor 19A*a* assigned to the holder portion 13A causes the chuck 15 to move in the direction A shown in FIG. 4. Subsequently, the motor 24A is driven to rotate the bottle 20. Consequently, the toner 5 is discharged from the bottle 20 via the mouth 23. How many times the lug 31 crosses the sensor 32A during rotation of the bottle 20 is stored in the counter 3. The toner 5 discharged from the bottle 20 is fed to the lower portion of the toner bank 300. When the toner height sensor 340 determines that the toner 5 has reached a preselected height or amount in the above portion of the toner bank 300, it sends its output to the control means 1. In response, the control means 1 sends a command to the motor 24A for stopping its operation.

Assume that the toner 5 is again determined to be absent in the lower portion of the toner bank 300 due to to repeated image formation. Then, control means 1 sends a drive signal to the holder portion 13A so as to feed the toner 5 from its bottle 20. When the toner height sensor 340 does not send its output to the control means 1 even after the motor 24A has been driven for a preselected period of time, the control means 1 deenergizes the motor 2, A, determining that the bottle 20 has been emptied. Then, the control means 1 drives the motors 19A in order to fit the zap 7*a* in the mouth 23 of the toner bottle 20, while displaying a message showing that the bottle of the holder portion 13A is empty.

After the bottle 20 of the holder portion 13A has been plugged, the control means 1 reads the counts associated with the sensors 32A–32C of the holder portions 13A–13C and stored in the counter 3. Then, the control means 1 sends a drive signal to either one of the holder portions 13B and 13C having the smallest count.

Assuming that the control means 1 selects the holder portion 13B by way of example, then, the drive motor 19B*a* is driven to remove the cap 7*a* from the bottle 20 held by the holder portion 13B. Subsequently, the motor 24B is driven to discharge the toner 5 from the bottle 20. The resulting output of the sensor 32B responsive to the lug 31 is counted by the counter 3. When the preselected amount of toner is fed, as determined by the toner height sensor 340, the control means causes the motor 14B to stop operating in response to the resulting output of the sensor 340.

Watching the message appearing on the operation panel, the operator pulls out the bottle 20 from the holder portion 13A, refills it with the toner 5, and then returns it to the holder portion 13A. Even during such replacement, the toner 5 is continuously replenished from the bottle 20 of the holder portion 13B. This makes it needless to interrupt the operation of the copier.

When the toner height sensor 340 does not send its output to the control means 1 even after the motor 24B has been driven for a preselected period of time, the control means 1 deenergizes the motors 24B, determining that the bottle 20 has been emptied. Then, the control means 1 drives the motors 19B*a* in order to fit the cap 7*a* in the mouth 23 of the bottle 20, while displaying a message showing that the bottle 20 of the holder portion 13B is empty.

After the bottle 20 of the holder portion 13B has been plugged, the control means 1 reads the counts associated with the sensors 32A–32C of the holder portions 13A–13C and stored in the counter 3. Then, the control means 1 sends a drive signal to the holder portion 13C having the smallest count. Thereafter, the toner 5 is fed from the bottle 20 of the holder portion 13C in the same manner.

The above procedure allows the toner 5 to be continuously fed without image formation being interrupted. In addition, the holder portions 13A–13C are operated evenly and therefore with even service lives. It is possible to manage the toner bank 300 collectively in place of managing the individual holder portion.

When the number of outputs of any one of the sensors 32A–32C stored in the counter 3 coincides with the preselected value, the control means 1 may operate one of the motors 19A*a*–19C*a* associated with the above sensor, determining that the bottle 20 has run out of the toner 5. As a result, the motor causes the associated chuck 15 to fit the cap 7*a* in the mouth 23 of the bottle 20. At the same time, the message mentioned earlier may be displayed on the operation panel.

If desired, when all the bottles 20 are emptied or when all the counts relating to the bottles 20 are close to counts representative of an empty condition, the control means 1 may initialize the holder-by-holder counts.

A second specific procedure for replenishing, after one bottle 20 has been fully emptied, the toner 5 from another bottle 20 is as follows. When the toner 5 is determined to be absent in the lower portion of the toner bank 300, as in the first procedure, the control means 1 scans the counter 3 and sends a drive signal to one of the holder portions 13A–13C relating to the sensor smaller than the other sensors in the number of outputs counted in the past, or sends it to any one of the holder portions 13A–13C if the numbers of outputs are the same, as stated earlier. Initially, the control means 1 sends the drive signal to the holder portion 13A.

In response to the drive signal, the motor 19A*a* assigned to the holder portion 13A causes the chuck 15 to move in the direction A shown in FIG. 4. The chuck 15 nips the lug 7*b* of the cap 7*a* with its flexible nip portion 15*b* and pulls the cap 7*a* out of the bottle 20, as shown in FIG. 5. At the same time, the lug 33 is sensed by the sensor 34A. Subsequently, the motor 24A is driven to rotate the bottle 20 with the result that the toner 5 is discharged from the bottle 20 via the mouth 23. When the toner height sensor 340 determines that the toner 5 has reached the preselected height or amount in the above portion of the toner bank 300, it sends its output to the control means 1. In response, the control means 1 sends a command to the motor 24A for stopping its operation.

When the toner 5 is determined to be absent in the lower portion of the toner tank 300 due to repeated image formation, the toner 5 is again fed from the same bottle 20. When the toner height sensor 340 does not send its output to the control means 1 even after the motors 24A has been driven for a preselected period of time, the control means 1 deenergizes motors 24A, determining that the bottle 20 has been emptied. Then, the control means 1 drives the motors 19A*a* in order to fit the cap 7*a* in the mouth 23 of the bottle 20, while displaying a message showing that the bottle 20 of the holder portion 13A is empty. In this, case, the sensor 34A responsive to the movement of the chuck 15 sends its output to the control means 1, and the output is counted by the counter 3.

Subsequently, the control means 1 reads the holder-by-holder counts stored in the counter 3 and sends a drive signal to the holder portion 13B or 13C having the smallest count. In this case, either one of the holder portions 13B and 13C is selected.

Assume that the holder portion 13B is selected. Then, the motor 19B*a* is driven to fit the cap 7*a* in the mouth 23 while the resulting output of the sensor 341B is counted by the counter 3. On the increase of the toner 5 to the preselected amount, as determined by the toner height sensor 340, the control means 1 causes the motor 24B to stop operating.

Watching the message appearing on the operation panel, the operator pulls out the bottle 20 from the holder portion 13A, refills it with the toner 5, and then returns it to the holder portion 13A. Even during such replacement, the toner 5 is continuously replenished from the bottle 20 of the holder portion 13B. This makes it needless to interrupt the operation of the copier.

When the toner height sensor 340 does not send its output to the control means 1 even after the motor 24B has been driven for a preselected period of time, the control means 1 deenergizes the motors 24B, determining that the bottle 20 has been emptied. Then, the control means 1 drives the motors 19B*a* in order to fit the cap 7*a* in the mouth 23 of the bottle 20, while displaying a message showing that the bottle 20 of the holder portion 13B is empty on the operation panel. At this instant, the output of the sensor 34B is counted by the counter 3.

Thereafter, the control means 1 reads the counts associated with the sensors 32A–32C of the holder portions 13A–13C and stored in the counter 3. Then, the control means 1 sends a drive signal to the holder portion 13C having the smallest count. Subsequently, the toner 5 is fed from the bottle 20 of the holder portion 13C in the same manner.

The above procedure allows the toner 5 to be continuously fed without image formation being interrupted. In addition, the holder portions 13A–13C are operated evenly and therefore with even service lives. It is possible to manage the toner bank 300 collectively in place of managing the individual holder portion.

If desired, when all the bottles 20 are evenly used, the control means 1 may initialize the holder-by-holder counts. This digitizes the counts and thereby promotes easy control.

Again, while the toner bank 300 shown and described has three holder portions 13A–13C each holding the respective toner bottle 20, it may accommodate any desired number of toner bottles if it is two or above. When two toner bottles accommodated in the toner bank 300, the holder portions are used evenly without fail because one bottle is used during replenishment to the other bottle.

As stated above, the first embodiment of the present invention has various unprecedented advantages, as enumerated below.

(1) With sensing means responsive to the frequencies of use, it is possible to use toner bottles each being arranged in a particular position in a toner bank evenly, i.e., to uniforms the deterioration of mechanical parts.

(2) One toner bottle used or replaced the smallest number of times is used before the other toner bottles. This achieves, in addition to the above advantage (1), an advantage that a machine suffers from a minimum of fault while the toner bottle storing portions of the toner bank operate evenly. As a result, the storing portions have a uniform service life and allows the toner bank to be managed collectively.

(3) Toner discharged from each toner bottle is fed to a toner transport path defined in the toner back by way of a respective passageway. This prevents toner discharged from one toner bottle from smearing another toner bottle. In addition, the toner can be easily replenished to the toner bank because the replenishment is implemented by the replacement of the toner bottle.

(4) Each toner bottle is rotated by respective drive means so as to discharge the toner. An anti-bridge member is disposed in each passageway and interlocked to the drive means. This prevents the toner from bridging in the passageway.

(5) A vent portion is positioned above the passageway in order to prevent the toner from flying and circulating within the toner bank and smearing the toner bottles.

2nd Embodiment

Figure 15:
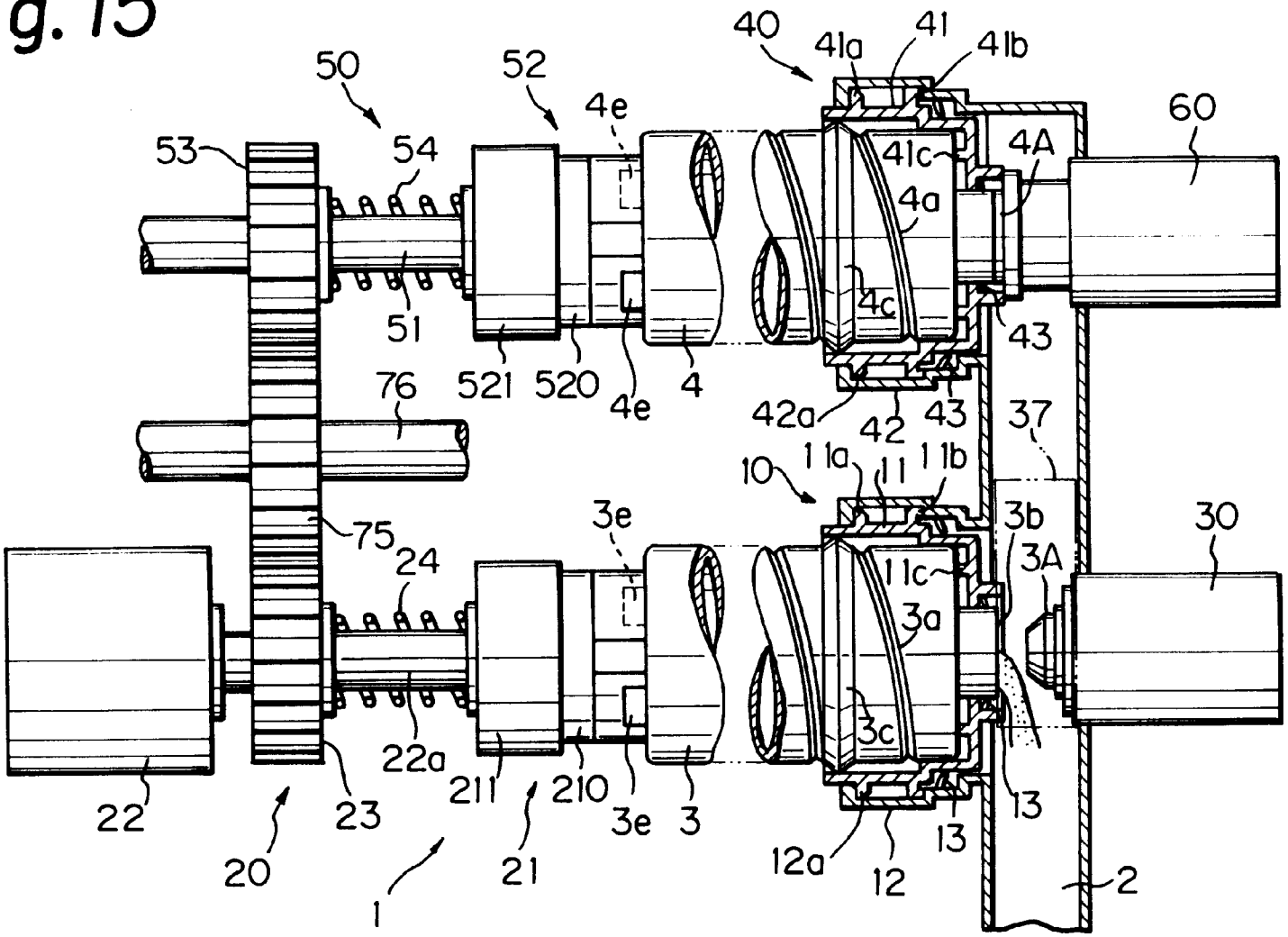
FIG. 15 is a sectional view showing a toner replenishing device representative of a second embodiment of the present invention.

Referring to FIG. 15, a toner replenishing device representative of a second embodiment will be described. As shown, the toner replenishing device, generally 1, is positioned above a developing unit, not shown, and communicated to the developing unit by a passageway 2 for toner replenishment. The developing unit is substantially the same as the developing unit 80, FIG. 1, and will not be described specifically.

As shown, the toner replenishing device 1 includes a first and a second toner bottle 3 and 4, respectively, each storing toner therein. The toner bottles 3 and 4 are positioned one above the other, i.e., the first bottle a is positioned below the second bottle 4. With the two bottles 3 and 4, it is possible to reduce the frequency of replacement of a toner bottle and therefore the time and labor for replacement even when toner is consumed in a great amount.

The bottles 3 and 4 are held by bottle holding means 10 and 40, respectively. Bottle rotating means 20 and 50 respectively rotate the bottles 3 and 4 in the event of toner replenishment. Plugging/unplugging means 30 and 60 respectively fit and remove caps 3A and 4A from the bottles 3 and 4. These various means each can be operated independently of the others under the control of control means 70 which will be described.

The bottle holding means 10 and 40 and plugging/unplugging means 30 and 60 assigned to the bottles 3 and 4, respectively, are identical in configuration. The following description concentrate on the bottle holding means 10 and plugging/unplugging means 30 by way of example. Also, because the two bottles 3 and 4 are identical in configuration, only the bottle 3 will be described; the means assigned to the bottle 4 will be denoted by references similar to the references of the bottle 3.

Figure 16:
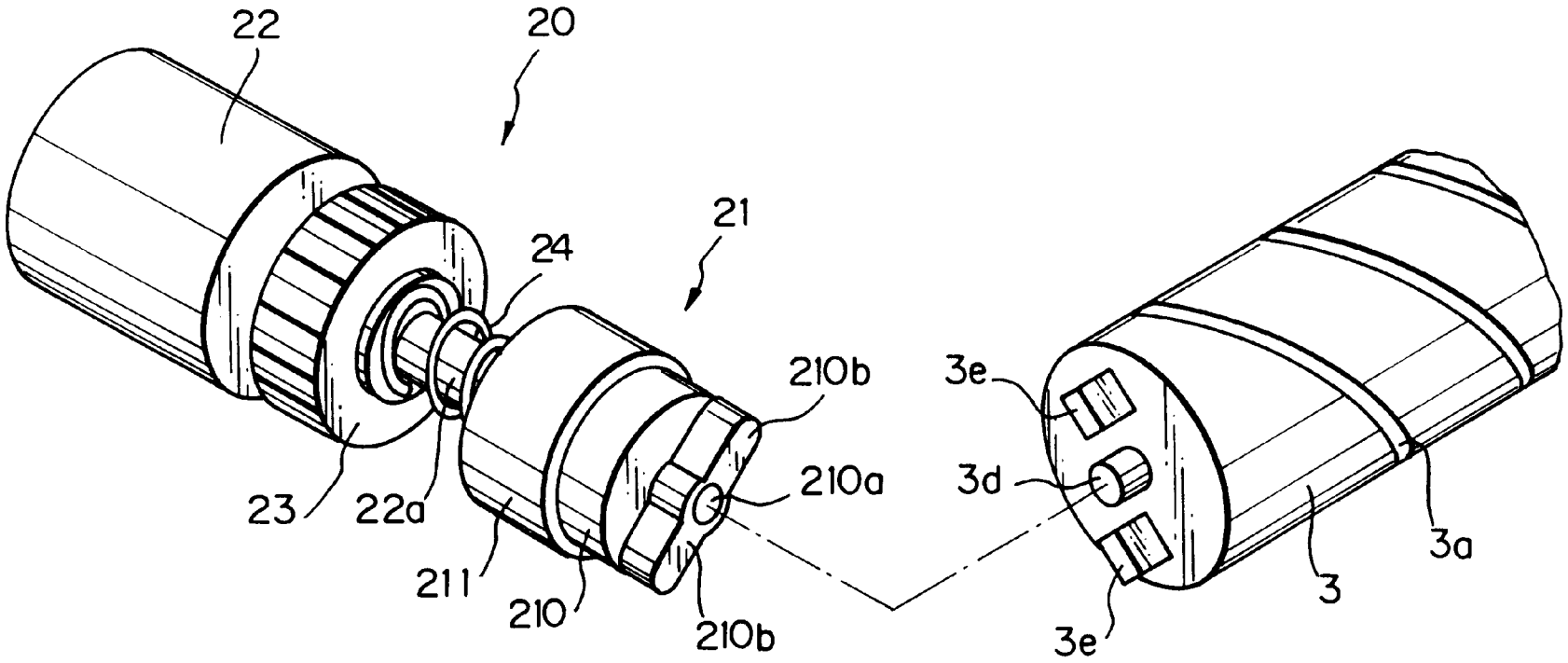
FIG. 16 is an exploded perspective view showing a toner bottle included in the second embodiment together with bottle rotating means.

The bottle 3 is a hollow cylindrical member formed with a spiral groove 3*a* in its circumferential wall. The spiral groove 3*a* protrudes into the bottle 3. When the bottle 3 is rotated, the groove 3*a* guides the toner toward a mouth or toner outlet 3*b* formed in the bottle 3. The cap 3A is fitted in the mouth 3*b* in order to prevent the toner from flowing out while the bottle 3 is out of use. An annular ridge 3*c* protrudes outward from the circumferential surface of the bottle 3 in t h e vicinity of the mouth 3*b*. The ridge 3*c* mates with a sleeve 11, which will be described, included in the bottle holding means 10. As shown in FIG. 16, the bottle 3 has on its bottom a cylindrical lug 3*d* and a pair of rectangular lugs 3*e* engageable with a joint portion 210, which will be described, included in the bottle rotating means 20. The lug 3*d* is positioned substantially at the center of the bottom of the bottle 3 while the two lugs 3*e* are symmetrical to each other with respect to the lug 3*d*.

Figure 17:
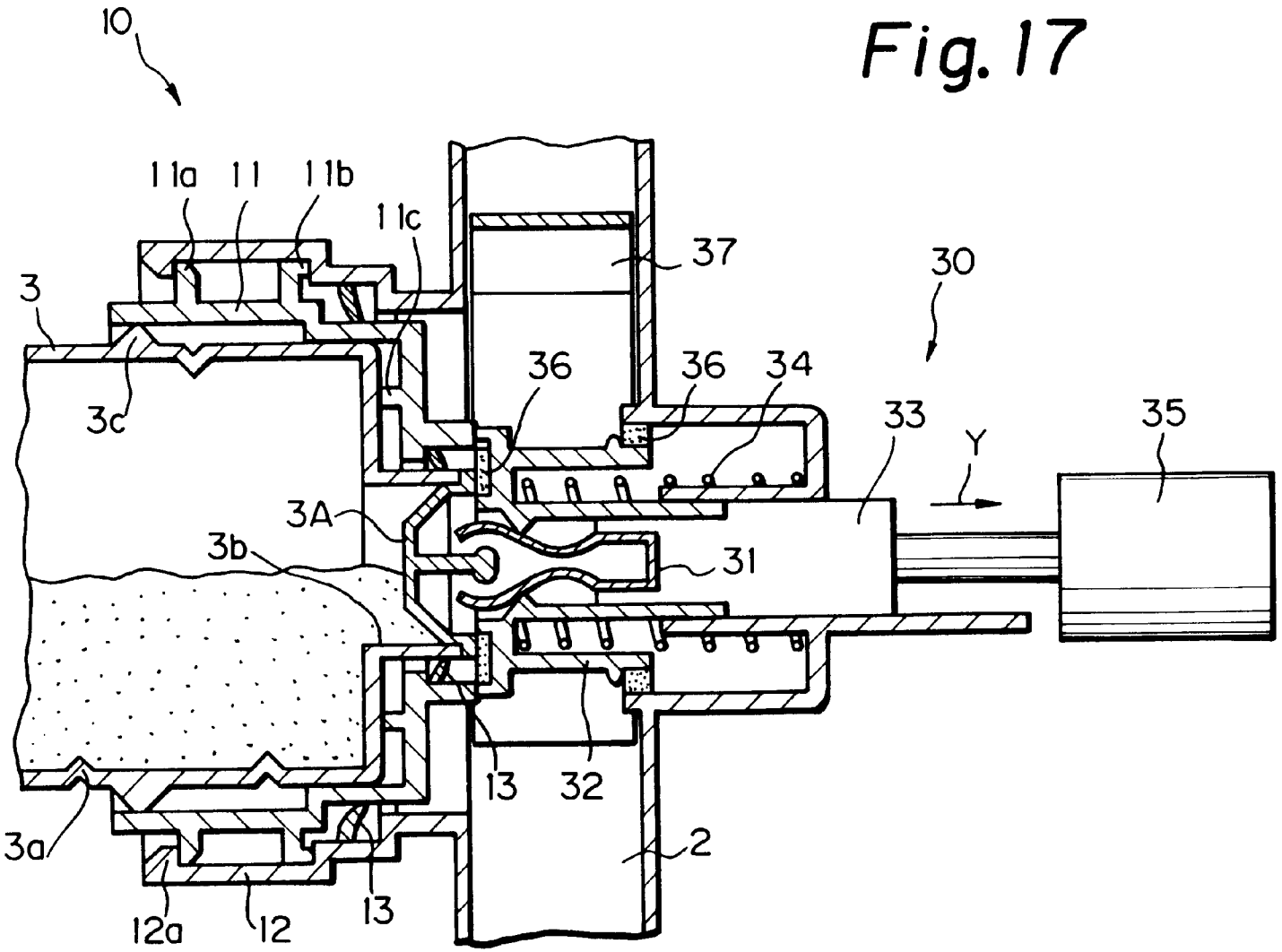
FIG. 17 is a section showing the toner bottle of FIG. 16 mounted to a sleeve for describing the operation of the second embodiment.
Figure 18:
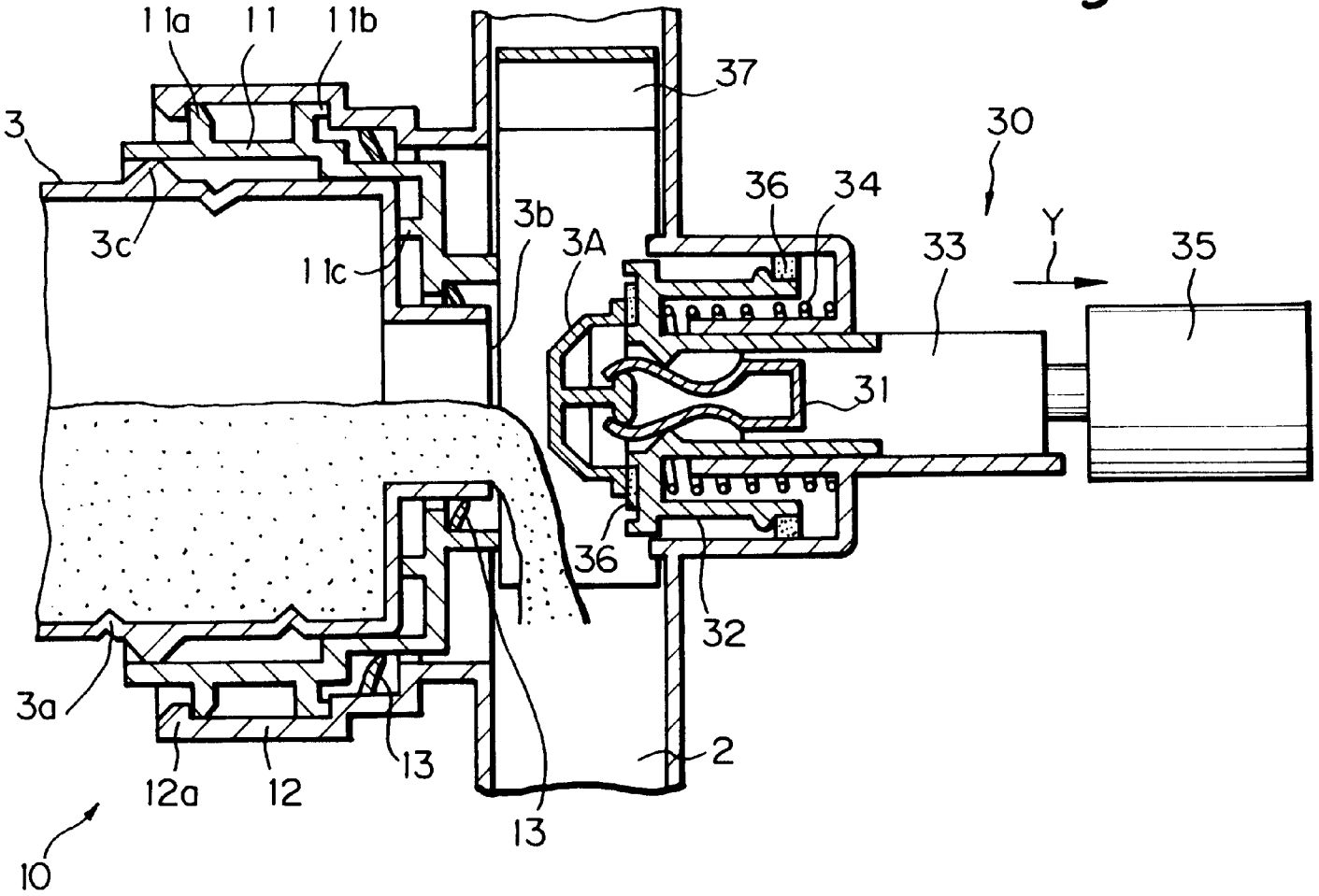
FIG. 18 is a sectional view showing the second embodiment in a condition wherein a cap is removed from the toner bottle by a collet chuck to allow toner to flow out.

As shown in FIGS. 15, 17 and 18, the bottle holding means 10 is arranged on the side wall of the passageway 2. The bottle holding means 10 is made up of the sleeve 11 for retaining the mouth 3*b* of the bottle 3 in engagement with the annular ridge 3*c*, and a support portion 12 rotatably supporting the sleeve 1I. The sleeve 11 has a larger diameter than the bottle 3. A pair of ribs 11*a* and 11*b* are formed on the outer circumferential surface of the sleeve 11 and held in slidable contact with the inner circumferential surface of the support portion 12. A stop 11*c* is formed on the sleeve 11 in the vicinity of the mouth 3*b* of the bottle 3 in order to limit the position of the bottle 3. The support portion 12 is formed integrally with the side wall of the passageway 2 and provided with a hollow cylindrical configuration to accommodate the sleeve 11. A lug 12*a* is formed on the support portion 12 and engaged with the rib 11*a* for preventing the sleeve 11 from slipping out. An elastic seal 13 is positioned between the bottle 3 and the sleeve 11 while another elastic seal 13 is positioned between the sleeve 11 and the support portion 12.

As shown in FIG. 17, the plugging/unplugging means 30 is arranged on the other side wall of the passageway 2 opposite to the side wall on which the bottle holding means 10 is arranged. The plugging/unplugging means 30 has a collet chuck 31 for nipping or releasing the cap 3A, a cylindrical case 32 accommodating the collet chuck 31, a beady 33 to which the collet chuck 31 and case 32 are affixed, a coil spring 34 constantly biasing the body 33 toward the bottle 3, and a solenoid 35 for moving the body 33 back and forth. Reference numeral 36 designates a seal.

Figure 19:
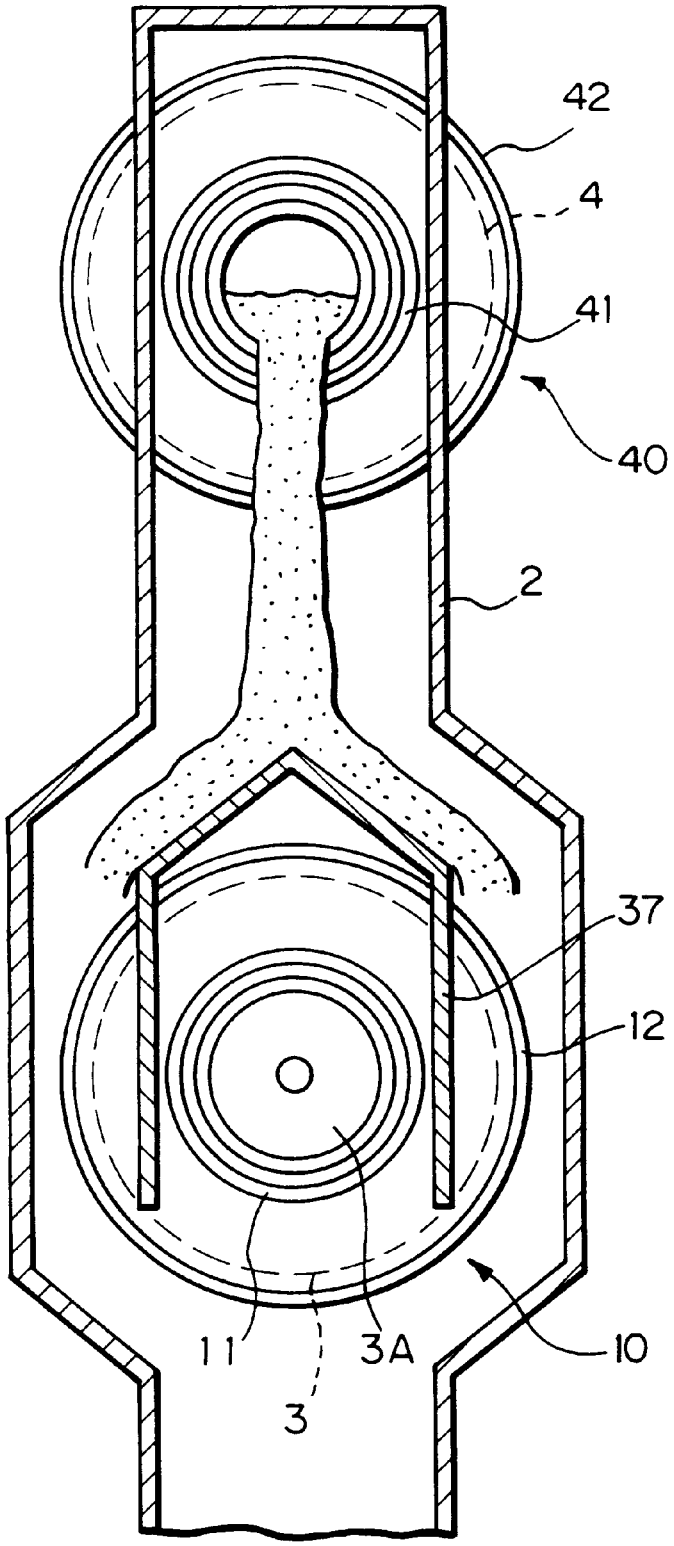
FIG. 19 is a sectional view showing a passageway included in the second embodiment.

As shown in FIGS. 17 and 19, a cover 37 is disposed in the passageway 2 above the plugging/unplugging means 30 in such a manner as to cover the means 30 and the mouth 3*b* of the bottle 3. The cover 37 receives the toner dropping from the other bottle 4. The portion of the passageway 2 where the cover 37 is located has a larger width than the other portion, so that the toner dropping from the bottle 4 can be passed through the passageway 2. It is to be noted that the cover 37 is assigned only to the plugging/unplugging means 30 and first bottle 3.

Referring again to FIG. 15, the bottle rotating means 20 is positioned at the rear of the bottom of the bottle 3. The bottle rotating means 20 has a joint unit 21 engageable with the bottom of the bottle 3, and a motor 22 for rotating the joint unit 21 and including a decelerator. The joint unit 21 is mounted on the output shaft 22*a* of the motor 22 in such a manner as to be movable back and forth in the axial direction of the shaft 22*a*. A gear 23 is affixed to the shaft 22*a* between the joint unit 21 and the motor 22. A coil spring 24 intervenes between the joint unit 21 and the gear 23 and biases the joint unit 21 toward the bottle 3.

The joint unit 21 has, in addition to the joint portion 210, a clutch portion 211 for selectively coupling or uncoupling the joint portion 210 to or from the motor 22. As shown in FIG. 16, A recess 210*a* and a pair of lugs 210*b* are formed on the end of the joint portion 210. The recess 210*a* will mate with the lug 3*d* while the lugs 210*b* will be positioned between the two lugs 3*e*. The lugs 210*b* are formed integrally with the recess 210*a*. The recess 210*a* and lug 3*d* cooperate to retain the bottom of the bottle 3 when engaged with each other. The two lugs 3*e* and two lugs 210*b* cooperate to transfer the rotation of the joint portion 210 to the bottle 3 when engaged with each other. The clutch portion 211, which is a conventional clutch, selectively sets up the transmission of rotation from the motor 22 to the bottle 3 or interrupts it.

As shown in FIG. 15, the bottle rotating means 50 includes a shaft 51 journalled to a side wall, not shown, included in the copier. A joint unit 52 is mounted on the shaft 51 in such a manner as to be movable back and forth in the axial direction of the shaft 51. A gear 53 is affixed to the shaft 51. A coil spring 54 intervenes between the joint unit 52 and the gear 53. The joint unit 52, like the joint unit 21, has a joint portion 520 engageable with the bottom of the second bottle 4, and a clutch portion 521 for selectively transmitting the rotation of the gear 53 to the joint portion 520. An idler gear 75 is affixed to a shaft 76 and held in mesh with the gears 23 and 53. The shaft 76 is also joumalled to the side wall of the copier.

Figure 20:
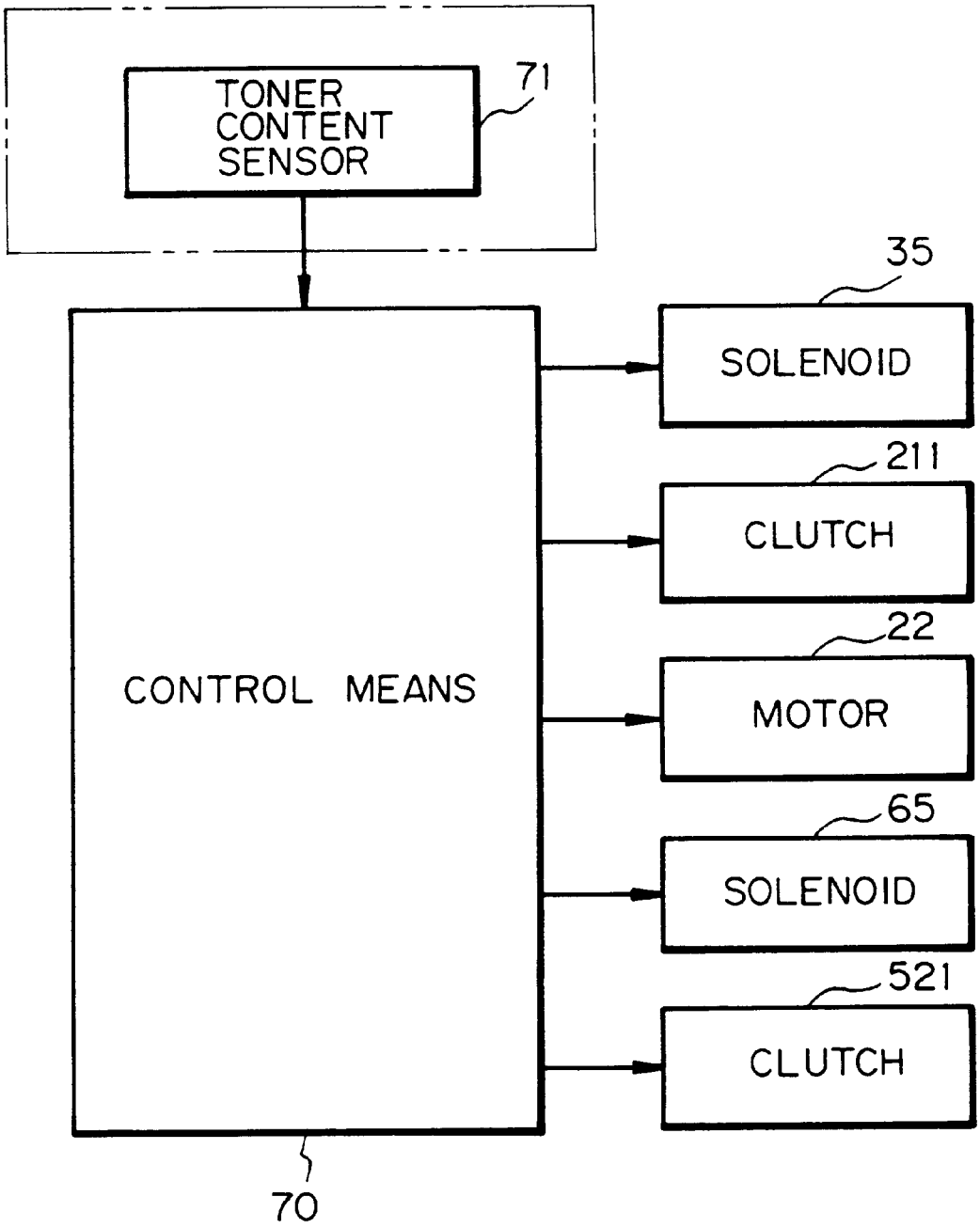
FIG. 20 is a block diagram schematically showing a control system included in the second embodiment.

As shown in FIG. 20, the solenoids 35 and 65 of the plugging/unplugging means 30 and 60, the clutches 211 and 521 of the bottle rotating means 20 and 50 and the motor 22 of the bottle rotating means 20 are connected to the control means 70 located in a preselected position in the copier. Also connected to the control means 70 is a toner content sensor 71 mounted on the developing unit. The control means 70 controls the operation of the individual means in response to the output of the toner content sensor 71.

In operation, the first bottle bottle 3 has its shoulder portion abutted against the stop 11*c* with the annular ridge 3*c* mating with the sleeve 11. As a result, the end of the bottle 3 where the mouth 3*b* is present is positioned relative to the sleeve 11. Subsequently, the joint portion 210 is brought into engagement with the bottom of the bottle 3 so as to retain it. In this condition, the bottle 3 is mounted to the toner replenishing device. Likewise, the second bottle 4 is mounted to the device 1 by the sleeve 41 and joint portion 520.

Thereafter, one of the two bottles 3 and 4 from which the toner should be replenished, i.e., the first bottle 3 in this embodiment is unplugged in response to a command received from the control means 70. Specifically, as shown in FIG. 17, the solenoid 35 is energized in order to move the body 33 and therefore the collet chuck 31 in the direction indicated by an arrow Y. As a result, the collet chuck 31 nips the cap 3A fitted in the mouth 3*b* of the bottle 3. As the collet chuck 31 is further moved in the direction Y, the collet chuck 31 pulls the cap 3A out of the mouth 3*b*. In this condition, the toner existing in the bottle 3 is ready to flow out.

Assume that the output of the toner content sensor 71 sent to the control means 70 is representative of a toner content lower than a preselected reference value. Then, the control means 70 drives the bottle rotating means 20, i.e., motor 22. The resulting rotation of the motor 22 is transmitted to the joint portion 210 via the clutch 211, causing the joint portion 210 to rotate. Consequently, the lugs 210*b* of the joint portion 21 are positioned between the lugs 3*e* of the bottle 3 and cause the bottle 3 to rotate. The spiral groove 3*a* of the bottle 3 drive the toner in the bottle 3 toward the mouth 3*b*. As a result, the toner is discharged from the bottle 3 to the passageway 2 via the mouth 3*b*.

Figure 21A:
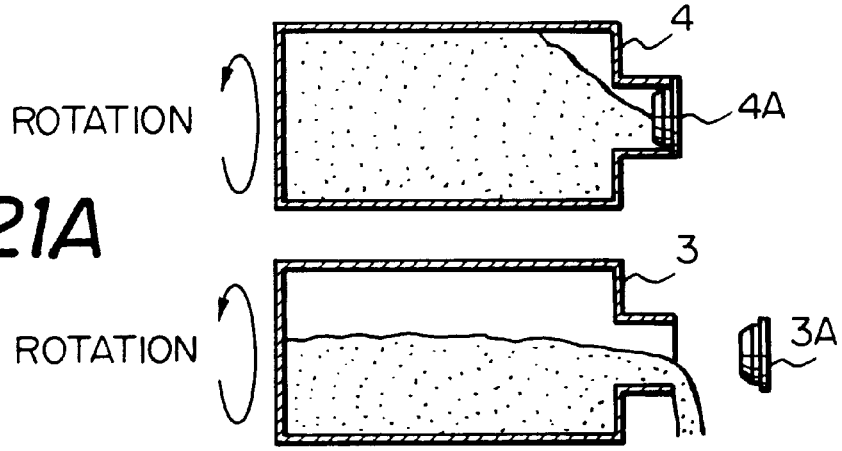
FIGS. 21A–21C are sectional views each showing toner bottles included in the second embodiment in a particular condition.
Figure 21B:
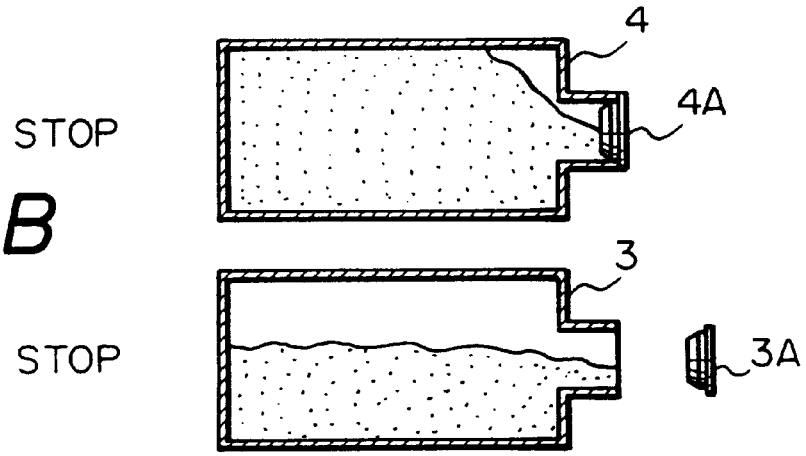
Figure 21C:
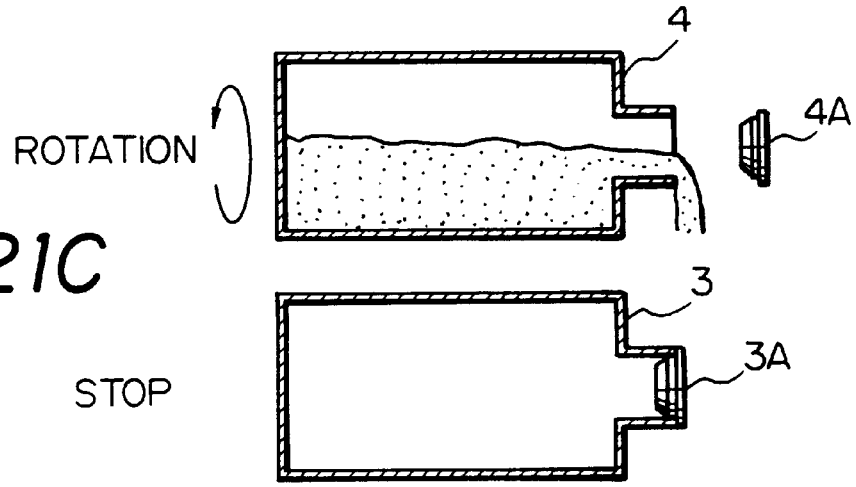

Reference will be made to FIGS. 21A–21C for describing the rotation of the first and second bottles 3 and 4 in detail. FIG. 21A shows a condition wherein the toner is replenished from the first bottle 3 to the developing unit. For the replenishment from the bottle 3, the plugging/unplugging means 30 unplugs the bottle 3, and then the bottle rotating means 20 rotates the bottle 3, as stated earlier. While the bottle 3 is rotated by the motor 22, the shaft 51 is also rotated by the motor 22 via the gear 23, idler gear 75, and gear 53. At this instant, the clutch 521 of the bottle rotating means 50 is held inoperative, so that the rotation of the shaft 51 is transferred to the joint portion 520. Therefore, during replenishment from the bottle 3, the other bottle 4 is also rotated. This successfully agitates the toner in the bottle 4, which will be replenished later, and thereby prevents it from cohering. Because the toner in the bottle 4 is maintained in such a desirable condition, it is prevented from adhering to the inner periphery of the bottle 4 and can be effectively fed to the developing unit later.

FIG. 21B shows a condition wherein the replenishment from the first bottle 3 is interrupted. When the output of the toner content sensor 71 shows the reference density during replenishment from the bottle 3, the control means 70 interrupts the operation of the bottle rotating means 20, i.e., the replenishment from the bottle 3. On the stop of operation of the bottle rotating means 20, the rotation of the motor 22 and therefore the rotation of the second bottle 4 is stopped.

When the first bottle 3 runs out or the toner due to repeated replenishment, the second bottle 4 is substituted for the first bottle 3 in order to continue the replenishment, as shown in FIG. 21C. The control means 70 determines whether or not the first bottle 3 is empty on the basis of the toner content after the toner has been replenished from the bottle 3 for a preselected period of time. Specifically, if the toner content is lower than the reference value even after a preselected duration of replenishment, as determined by the toner content sensor 71, the control mans 70 determines that the bottle 3 is empty.

Before the switching of the bottle, the plugging/unplugging means 30 again fits the cap 3A in the first bottle 3, and then the clutch 211 of the bottle rotating means 20 is operated to disconnect the joint 210 from the shaft 22*a*. To replenish the toner from the second bottle 4, the plugging/unplugging means 60 removes the cap 4A from the bottle 4, and then the bottle rotating means 20 has its motor 22 energized to rotate the bottle 4. The rotation of the motor 22 is transmitted to the shaft 51 via the gear 23, idler gear 75, and gear 53. At this instant, the clutch 521 of the bottle rotating means 50 is held inoperative, so that the rotation of the shaft 51 is transferred to the joint portion 520 so as to rotate the second bottle 4. Because the clutch 211 of the bottle rotating means 20 is held inoperative, the rotation of the shaft 22*a* is not transferred to the joint portion 210, preventing the first bottle 3 from rotating. Therefore, the first bottle 3 remains in a halt during replenishment from the second bottle 4. This successfully obviates, for example, noise ascribable to the rotation of the empty bottle 3 and reduces the power consumption of the motor 22.

As stated above, when the two bottles 3 and 4 are emptied, i.e., when all the toner is fed from the bottles 3 and 4, the device urges the operator to replace the empty bottles. If desired, when either one of the two bottles 3 and 4 is emptied, the device may urge the operator to replace only the empty bottle.

While this embodiment has been shown and describing as using the first bottle 3 first, it may use the second bottle 4 first, in which case the above control over bottle rotation will be reversed.

3rd Embodiment

Figure 22:
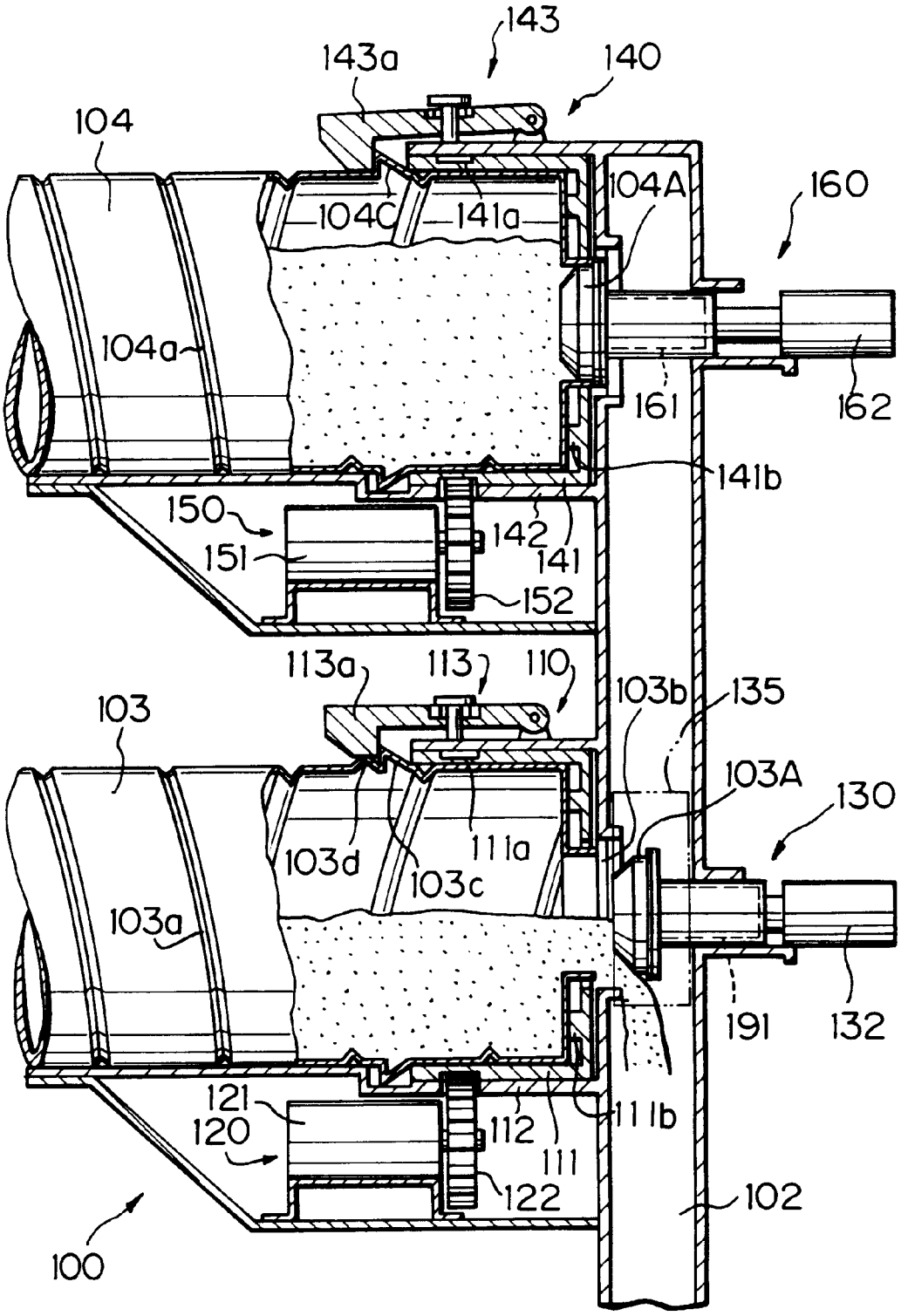
FIG. 22 is a sectional view showing a toner replenishing device representative of a third embodiment of the present invention.

Reference will be made to FIG. 22 for describing a third embodiment of the present invention. ks shown, a toner replenishing device, generally 100, is disposed above a developing unit, not shown, similar to the developing unit 80, FIG. 1. The device 100 is communicated to the developing unit by a passageway 102 for toner replenishment.

As shown, the toner replenishing device 100 includes a first and a second toner bottle 103 and 104 respectively, each storing toner therein. The bottles 103 and 104 are positioned one above the other, i.e., the first bottle 103 is positioned below the second bottle 104. The bottles 103 and 104 are held by bottle holding means 110 and 140, respectively. Bottle rotating means 120 and 150 respectively rotate the bottles 103 and 104 in the event of toner replenishment. Plugging/unplugging means 130 and 160 respectively fit and remove caps 103A and 104A from the bottles 103 and 104. These various means each can be operated independently of the others under the control of control means 170 which will be described.

Because the various means associated with the first and second bottles 103 and 104 are identical in configuration, the following description will concentrate on the means assigned to the first bottle 103 by way of example. Also, because the two bottles 103 and 104 are identical in configuration, only the bottle 103 will be described; the same structural elements of the bottle 4 will be denoted by references similar to the references of the bottle 3.

The first bottle 103 is a hollow cylindrical member formed with a spiral groove 103*a* in its circumferential wall.

The spiral groove 103*a* protrudes into the bottle 103. When the bottle 103 is rotated, the groove 103*a* guides the toner toward a mouth 310*b* formed in the bottle 103. The cap 103A is fitted in the mouth 103*b* in order to prevent the toner from flowing out while the bottle 103 is out of use. An annular ridge 103*c* protrudes outward from the circumferential surface of the bottle 103 in the vicinity of the mouth 103*b*. The ridge 103*c* is engageable with a locking portion 113, which will be described, included in the bottle holding means 110.

Figure 23A:
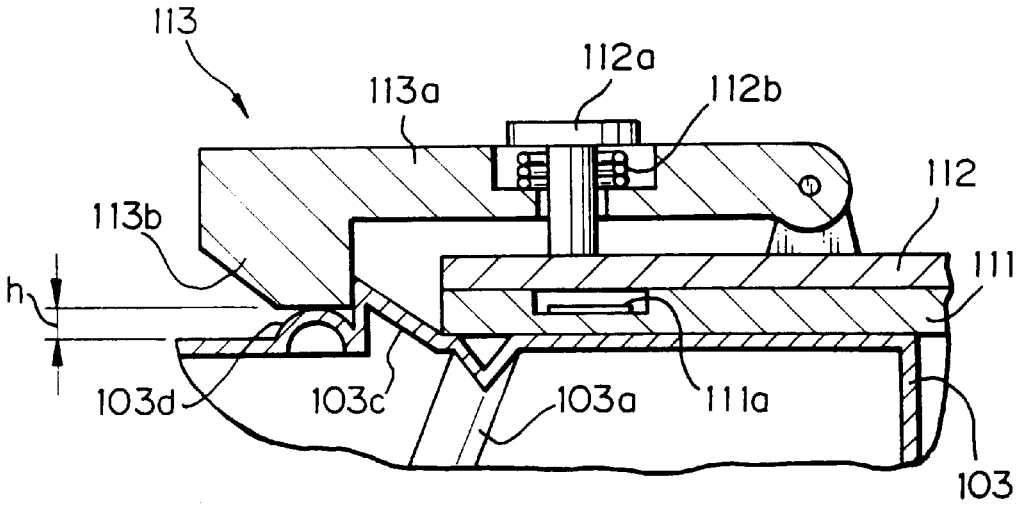
FIGS. 23A and 23B are sectional views each showing the third embodiment in a particular condition relating to an arm.

A single hemispherical lug 103*d* protrudes from the outer circumferential surface of the bottle 103 in the vicinity of the ridge 103*c*. The lug 103*d* has a height of 0.5 mm and forms a stepped portion on the periphery of the bottle 103. Specifically, as shown in FIG. 23A, assume that the height from the outer periphery of the bottle 103 to the top of the lug 103*d* is h. Then, in the illustrative embodiment, the height h is selected to be 0.5 mm. However, it is more preferable that the height h be greater than or equal to 0.5 mm.

As shown in FIG. 22, the bottle holding means 110 is arranged on one side wall of the passageway 102 and made up of a sleeve 111 for holding the bottle 103, a support portion 112 rotatably supporting the sleeve 111, and the locking portion 113 mentioned earlier. The sleeve 111 has a shape complementary to the mouth 103*b* of the bottle 103 and is so configured as to cover the mouth 103*b*. Gear teeth 111*a* are formed in the circumferential surface of the sleeve 111. A stop 111*b* protrudes fom the portion of the sleeve 111 adjoining the mouth 103*b* of the bottle 103 in order to limit the position of the bottle 103. The support portion 112 is formed integrally with the side wall of the passageway 102 and provided with a cylindrical configuration for receiving the sleeve 111. The locking portion 113 is positioned on the top of the support portion 112.

As shown in FIG. 23A, the locking portion 113 is implemented as an arm 113*a* rotatably mounted on the support portion 112. The arm 113*a* extends in the axial direction of the bottle 103 and is supported by the support portion 112 at its intermediate portion via a pin 112*a* and a spring 112*b*. The spring 112*b* biases the free end of the arm 113*a* toward the bottle 103. The arm 113*a* has at its free end a hook 113*b* engageable with the ridge 103*c* of the bottle 103 and slidable on the periphery of the bottle 103 and lug 103*d*. A low friction layer is formed on the surface of the hook 113*b* slidable on the bottle 103 and lug 103*d*.

Every time the bottle 103 makes one rotation, the hook 113*b* gets on the lug 103*d* and then falls. Just after the fall, the hook 113*b* lightly hits against the periphery of the bottle 103 due to the action of the spring 112*b*. In this sense, the hook 113 plays the role of impacting means for impacting the bottle 103 in accordance with the rotation of the bottle 103.

As shown in FIG. 22, the plugging/unplugging means 130 is arranged on the other side wall of the passageway 102 opposite to the side wall on which the bottle holding means 110 is arranged. The plugging/unplugging means 130, like the plugging/unplugging means 30 of the second embodiment, includes a collet chuck 131 for nipping or releasing the cap 103A and a solenoid 132 for moving the chuck 131 back an d forth. A cover 135, similar to the cover 37 of the second embodiment, is disposed in the passageway 102 in order to receive the toner dropping from the second bottle 104. The cover 135 covers the plugging/unplugging means 30.

The bottle rotating means 120 is arranged below the support portion 112 and made up of a motor 121 and a gear 122 mounted on the output shaft of the motor 121. The gear 122 is held in mesh with the gear teeth 11*a*. The rotation of the motor 121 is transmitted to the sleeve 111 via the gear 122 and gear teeth 111*a*, causing the first bottle 103 to rotate.

Figure 24:
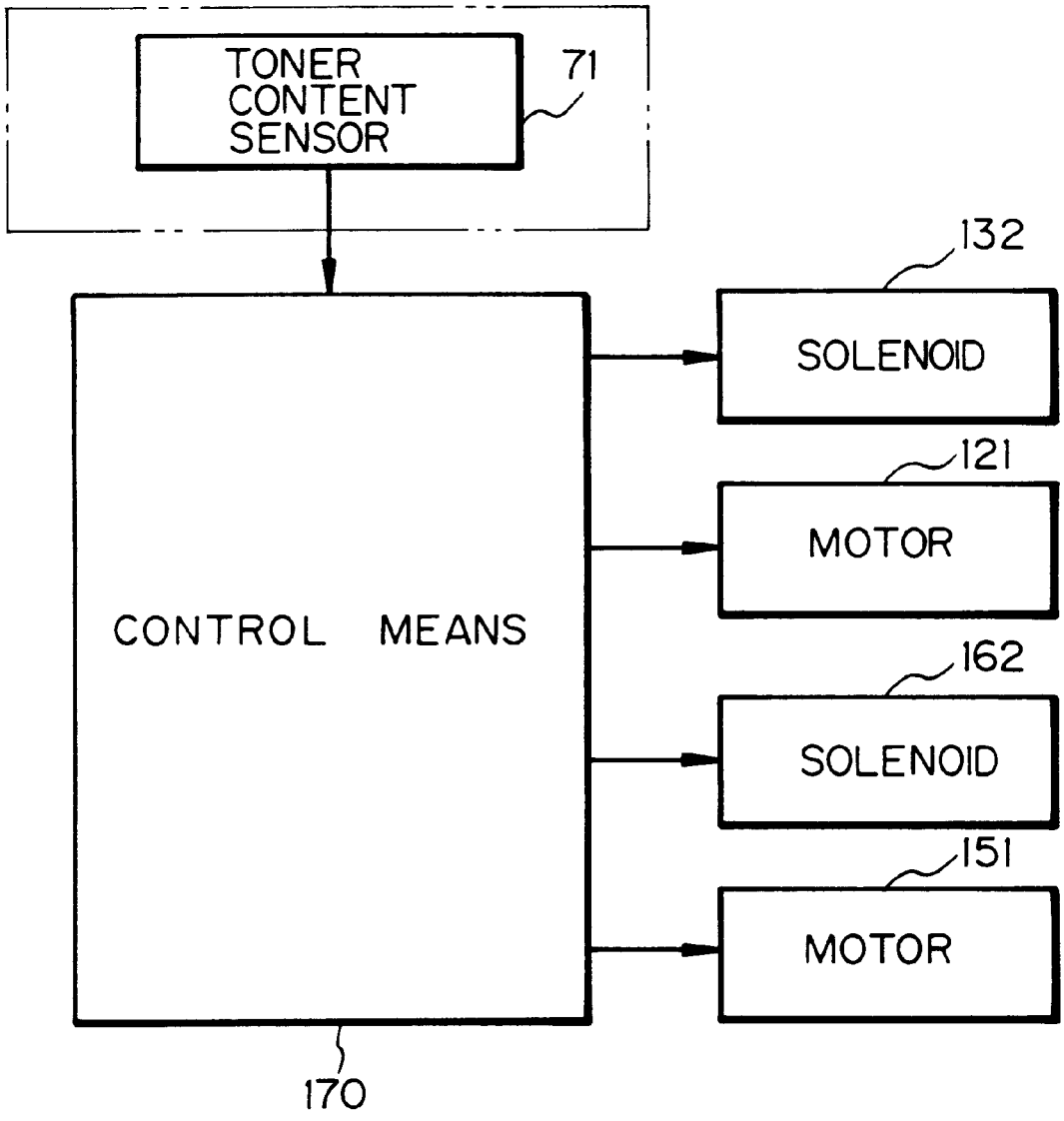
FIG. 24 is a block diagram schematically showing a control system included in the third embodiment.

As shown in FIG. 24, the solenoids 132 and 162 of the plugging/unplugging means 130 and 160 and the motors 121 and 151 of the bottle rotating means 120 and 150 are connected to the control means 170 situated at a preselected position in the copier. Also connected to the control means 170 is a toner content sensor 71 mounted on the developing unit. The control means 170 controls the individual means in response to the output of the toner content sensor 71.

In operation, the first bottle 103 has its annular ridge 103*c* engaged with the hook 113*b* while having its mouth portion inserted in the sleeve 111. As a result, the bottle 103 is positioned relative to the sleeve 111. Likewise, the second bottle 104 is mounted to the device 100 by a sleeve 141 and a hook 143*b*.

Thereafter, one of the two bottles 103 and 104 from which the toner should be replenished first, i.e., the first bottle 103 in this embodiment has its cap 103A removed in the same manner as in the second embodiment. Specifically, the solenoid 132 moves the collet chuck 131 in response to a command received from the control means 170.

Figure 25A:
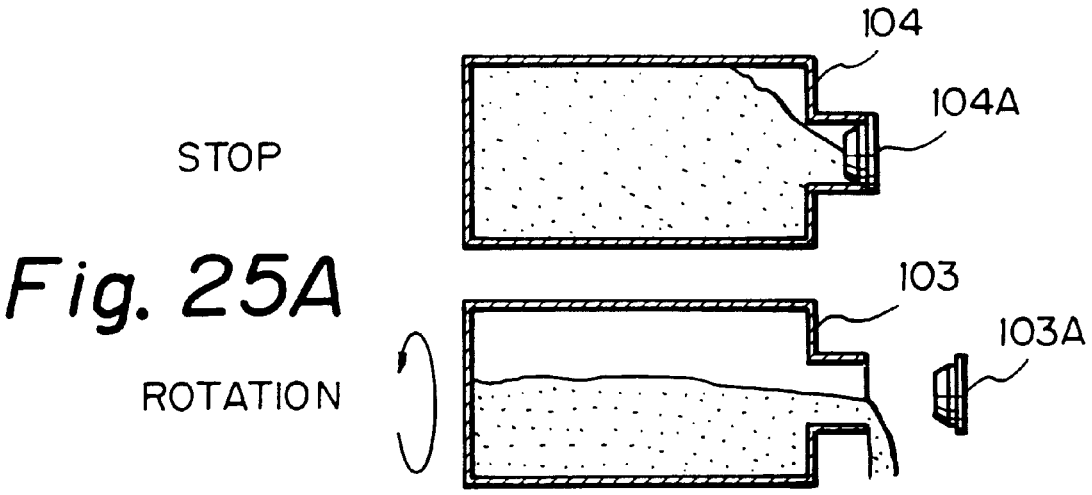
FIGS. 25A–25C are sectional views each showing toner bottles included in the third embodiment in a particular condition.
Figure 25B:
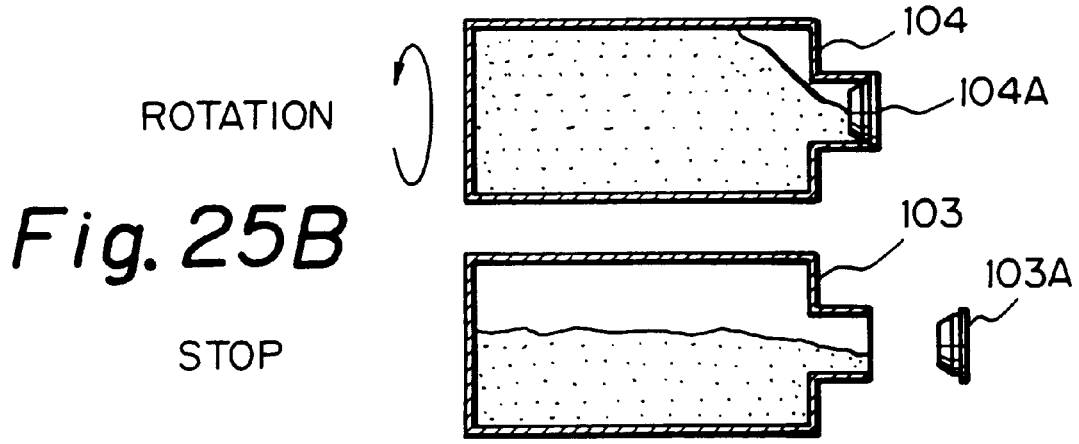
Figure 25C:
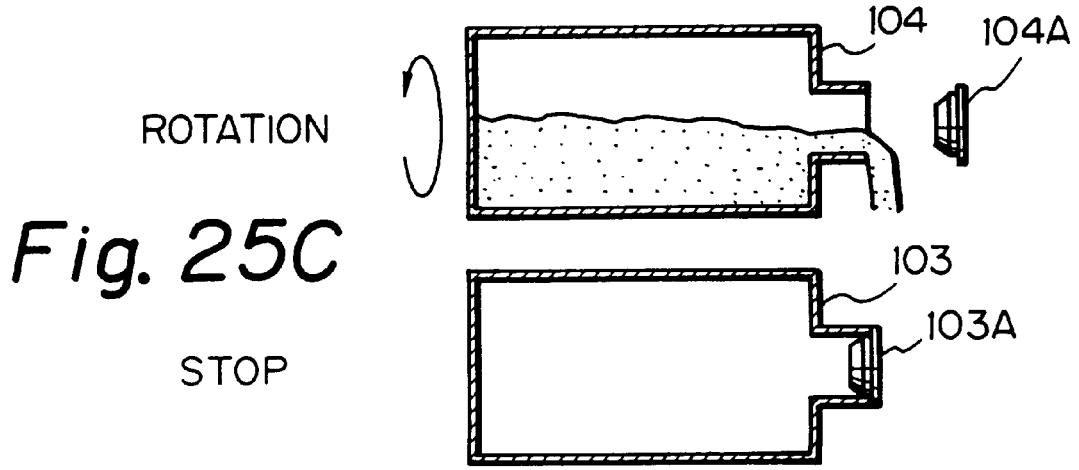

The rotation of the bottles 103 and 104 and toner replenishment will be described with reference to FIGS. 25A–25C in detail. FIG. 25A shows a condition wherein the toner is replenished from the first bottle 103. FIG. 25B shows a condition wherein the replenishment from the first bottle 103 is interrupted. FIG. 25C shows a condition wherein the toner is replenished from the second bottle 104.

Assume that the output of the toner content sensor 71 is representative of a toner content lower than a reference value due to repeated development. Then, as shown in FIG. 25A, the control means 170 causes the first bottle 103 to rotate via the motor 121. As a result, the toner in the bottle 103 is driven toward the mouth 103*b* by the spiral groove 103*a* and then discharged to the passageway 102 via the mouth 103*b*. While the first bottle 103 is in rotation, i.e. while the motor 121 is in operation, the motor 151 remains deenergized.

When the toner content increases to the reference value due to the replenishment from the first bottle 103, as determined by the toner content sensor 71, the control means 170 causes the motor 121 to stop rotating and thereby interrupts the replenishment from the first bottle 103. While the replenishment from the first bottle 103 is interrupted. i.e., while the sensor 71 does not send its output to the control means 170, the control means 170 causes the motor 151 and therefore the second bottle 104 to rotate for a preselected period of time. If the toner content being sensed by the sensor 71 decreases below the reference value while the motor 151 is in operation, the control means 170 deenergizes the motor 151 and again energizes the motor 121. In this manner, the second bottle 104 from which the toner will be replenished later is rotated while replenishment is not under way. This successfully agitates the toner in the second bottle 104 and prevents it from cohering.

While the illustrative embodiment rotates the second bottle 104 for the above purpose when the output of the toner content sensor 71 is absent, the bottle 104 may be rotated a preselected number of times a day, if desired.

Assume that the first bottle 103 has run out of the toner due to repeated replenishment. Then, the toner is replenished from the second bottle 104. To switch the bottle, the plugging/unplugging means 130 fits the cap 103A in the mouth of the first bottle 103, and then the plugging/unplugging means 160 removes the cap 104A from the mouth of the second bottle 104. The replenishment from the second bottle 104 is executed in the same manner as the replenishment from the first bottle 103. The motor 121 is not driven during replenishment from the second bottle 104, i.e., while the motor 151 is in operation.

Figure 23B:
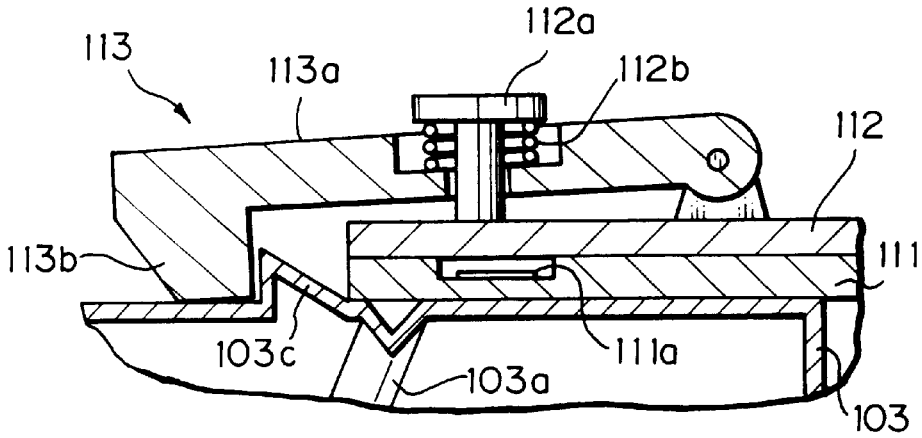

The locking portion 113 behaves while the first bottle 103 is in rotation, as follows. During replenishment from the first bottle 103, the lug 103*d* approaches the hook 113*b* due to the rotation of the bottle 103. The hook 113*b* gets on the lug 103*d* (see FIG. 23A) and then falls. Just after the all (see FIG. 23B), the hook 113*b* hits against the periphery of the bottle 103 and lightly impacts it. The impact acts on the bottle 103 every time the bottle 103 makes one rotation and causes the toner adhered to the inner periphery of the bottle 103 to come off. This allows a minimum of toner to be left in the bottle 103 and thereby promotes the effective replenishment from the bottle 103 to the developing unit.

When the toner is replenished from either one of the two bottles 103 and 104 or when the replenishment from the first bottle 103 is interrupted, one of the bottles 103 and 104 is rotated while the other is held in a halt. That is, it never occurs that both of the bottles 103 and 104 rotate at the same time. It follows that the impacting action of the locking portion 113 and that of the locking portion 143 do not overlap in timing, preventing noise from being aggravated.

If desired, the locking portions 113 and 143 playing the role of impacting means may be replaced with means provided on the bottles 103 and 104 for causing the bottles to vibrate, in which case the impact timing will be controlled bottle by bottle in order to reduce noise.

Again, when the first and second bottles 103 and 104 both run out of the toner or when one of them runs out of toner, the device 100 may urge the operator to replace the empty bottles or bottle.

The solenoid used to move the collet chuck may be replaced with means consisting of a rack, a pinion and a motor, if desired.

4th Embodiment

Figure 26:
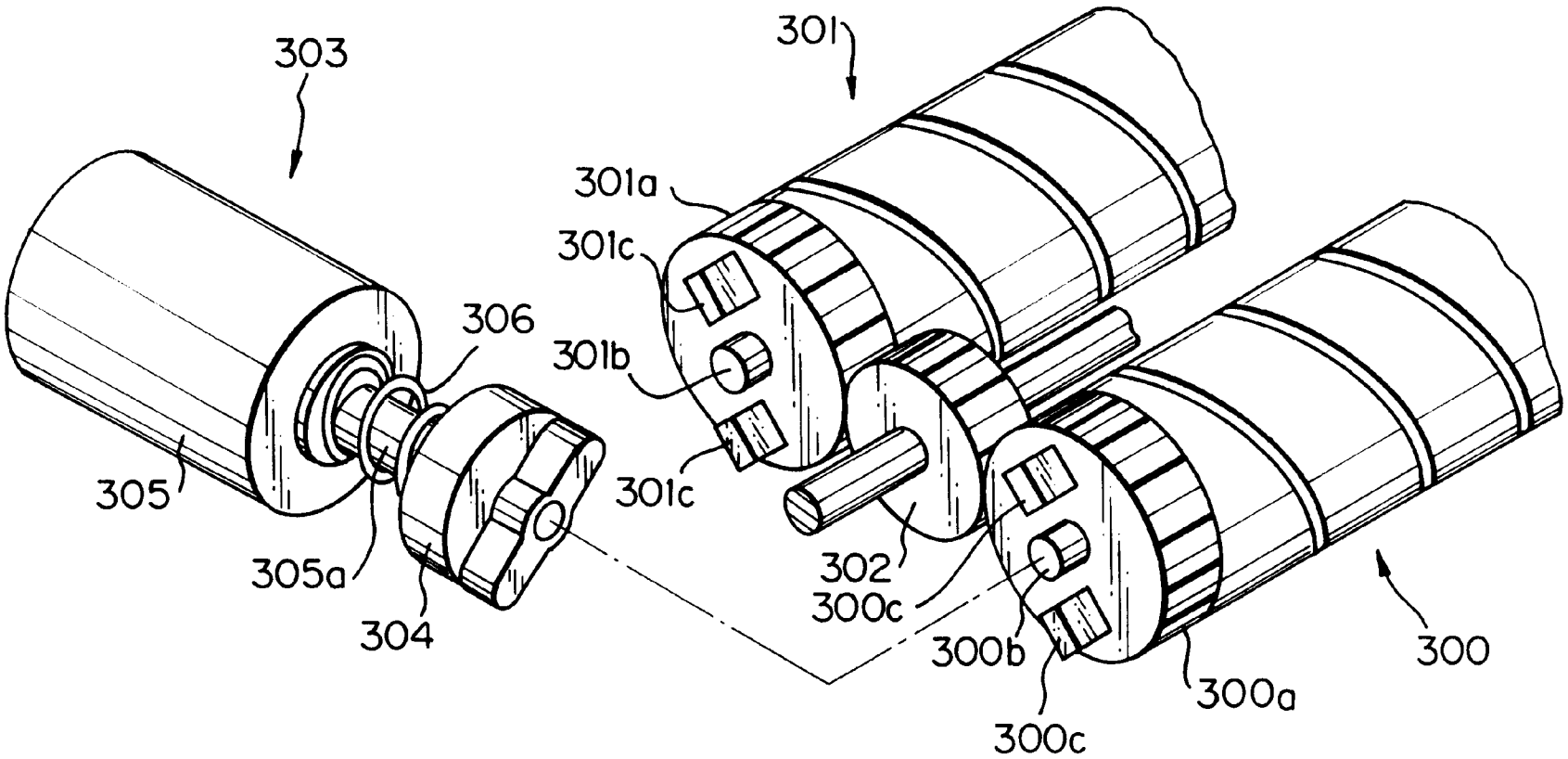
FIG. 26 is an exploded perspective view showing a toner replenishing device representative of a fourth embodiment of the present invention.

FIG. 26 shows a fourth embodiment of the present invention in which a first toner bottle 300 and a second toner bottle 301 are positioned side by side in the horizontal direction. Gears 300*a* and 301*a* are respectively mounted on the bottoms of the bottles 300 and 301. An idler gear 302 is journalled to a side wall, not shown, included in the copier and held in mesh with the gears 300*a* and 301*a* A cylindrical lug 300*b* and a pair of rectangular lugs 300*c*, similar to the lug 3*d* and lugs 3*e* of the second embodiment, are formed on the end of the gear 300*a*. Likewise, a cylindrical lug 301*b* and and a pair of rectangular lugs 301 are formed on the end of the bottom of the gear 301*a*.

Bottle rotating means 303 for rotating the first bottle 300 is so located as to face the bottom of the bottle 300. Although the bottle rotating means 303 i,, associated with the first bottle 300, it is shared by both of the bottles 300 and 301, as will be described later. The bottle rotating means 303 has a joint unit 304 engageable with the bottom of the first bottle 300, and a motor 305 for rotating the joint unit 304 and including a decelerator. The joint unit 304 is mounted on the output shaft 305*a* of the motor 305 in such a manner as to be movable back and forth in the axial direction of the shaft 305*a*. A coil spring 306 intervenes between the joint unit 304 and the motor 305 and constantly biases the joint unit 304 toward the first bottle 300.

In operation, the joint unit 304 is brought into engagement with the first bottle 300 and causes it to rotate. As a result, toner is replenished from the bottle 300 to the developing unit. The rotation of the first bottle 300 is transferred to the second bottle 301 via the gear 300*a*, idler gear 302, and gear 301*a*. This successfully agitates toner in the second bottle 301 during replenishment from the first bottle 300 and thereby prevents the toner of the bottle 301 from cohering. Because a single bottle rotating means is shared by the two bottles 300 and 301, the replenishing device is simple and low cost.

5th Embodiment

Figure 27:
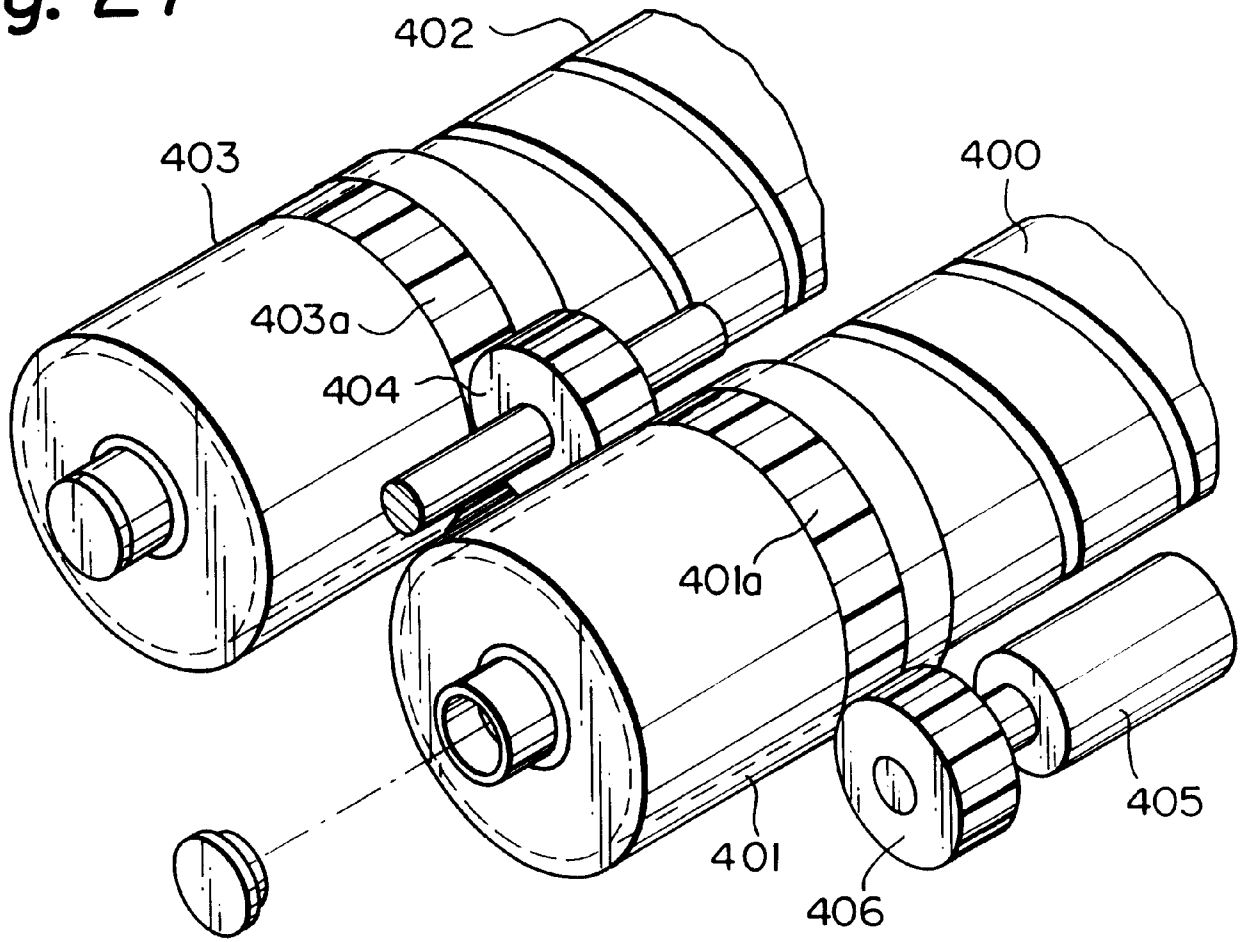
FIG. 27 is a perspective view showing a toner replenishing device representative of a fifth embodiment of the present invention.

FIG. 27 shows a fifth embodiment of the present invention which, like the third embodiment, causes a toner bottle to rotate together with a sleeve by positioning the mouth side of the bottle in the sleeve. As shown, sleeves 401 and 403 for receiving a first and a second toner bottle 400 and 402, respectively, are formed with gear teeth 401*a* and 403*a*, respectively. An idler gear 404 is positioned between the sleeves 401 and 403 and held in mesh with the gear teeth 401*a* and 403*a*. A motor 405 is positioned in the vicinity of the sleeve 401. A gear 406 is mounted on the output shaft of the motor 405 and held in mesh with the gear teeth 401*a*.

When the motor 405 is energized, its rotation is transmitted to the gear teeth 403 via the gear 406, gear teeth 401*a*, and idler gear 404. As a result, during replenishment from the first bottle 400, the second bottle 402 is rotated along with the first bottle 400, as in the fourth embodiment. Toner in the second bottle 402 is therefore successfully agitated.

Assume that the locking portions 113 and 114 of the third embodiment are applied to the first and second bottles 400 and 402 of the fifth embodiment. Then, only if the bottles 400 and 402 are respectively received in the sleeves 401 and 403 with their angles in the radial direction shifted from each other, the locking portions 113 and 143 each can impact the associated bottle 400 or 402 at a particular timing in order to reduce noise.

In summary, the second to fifth embodiments shown and described have the following advantages.

(1) Because a plurality of toner bottles or containers are available, the frequency of replacement of the bottles, i.e., the time and labor for the replacement is reduced even when toner is consumed in a great amount.

(2) Bottle rotating means causes all the bottles to rotate at the time of replenishment from any one, of the bottles. That is, even the bottle from which toner will be replenished later is rotated, and has its toner prevented from cohering. This ensures the fluidity of the toner and promotes the effective replenishment of the toner to a developing unit.

(3) When replenishment from one bottle is interrupted, the bottle rotating means causes the other bottle from which the toner will be replenished later to rotate for a preselected period of time. This is also successful to achieve the above advantage (2).

(4) The bottle rotating means prevents an emptied bottle from rotating and thereby obviates noise ascribable to such a bottle while reducing power consumption.

(5) Every time the bottle makes one rotation, impacting means applies an impact to the bottle and thereby causes the toner adhered to the inner periphery of the bottle to come off. This reduces the amount of toner to remain in the bottle and thereby enhances the effect replenishment to a developing unit.

(6) A plurality of impacting means each impacts the respective bottle at a particular timing and therefore produces a minimum of noise.

Various modifications will become possible for those skilled in the art after receiving the teachings of the present disclosure without departing from the scope thereof.

What is claimed is:

1. An image forming apparatus comprising:

developing means for feeding toner to a latent image electrostatically formed on an image carrier;

toner conveying means for conveying the toner toward said developing means;

a toner bank accommodating at least two toner bottles each storing the toner to be fed to said toner conveying means; and detecting means for detecting a frequency of use of an individual toner bottle;

wherein the toner is fed from one of said plurality of toner bottles selected to feed toner to said toner conveying means.

2. An apparatus as claimed in claim 1, wherein among of said plurality of toner bottles, a toner bottle having a smallest frequency of use as determined by said detecting means is selectable first.

3. An image forming apparatus comprising:

developing means for feeding toner to a latent image electrostatically formed on an image carrier;

toner conveying means for conveying the toner toward said developing means;

a toner bank accommodating at least two toner bottles each storing the toner to be fed to said toner conveying means; and detecting means for detecting a frequency of use of an individual toner bottle;

wherein the toner is fed from one of said plurality of toner bottles selected to feed toner to said toner conveying means, and when the toner bottle selected is emptied, another toner bottle is selectable.

4. An apparatus as claimed in claim 3, wherein among said plurality of toner bottles, a toner bottle having a smallest frequency of use as determined by said detecting means is selectable first.

5. An image forming apparatus, comprising:

developing means for feeding toner to a latent image electrostatically formed on an image carrier;

toner conveying means for conveying the toner toward said developing means;

a toner bank accommodating at least two replaceable toner bottles each storing the toner to be fed to said toner conveying means; and counting means for determining a frequency of replacement of an individual toner bottle;

wherein the toner is fed from any one of said plurality of toner bottles selected to feed toner to said toner conveying means.

6. An apparatus as claimed in claim 5, wherein of said plurality of toner bottles, a toner bottle having a smallest frequency of replacement as determined by said counting means is selectable first.

7. An image forming apparatus, comprising:

developing means for feeding toner to a latent image electrostatically formed on an image carrier;

toner conveying means for conveying the toner toward said developing means;

a toner bank accommodating at least two replaceable toner bottles each storing toner to be fed to said toner conveying means; and counting means for determining a frequency of replacement of an individual toner bottle;

wherein the toner is fed from one of said plurality of toner bottles selected to feed toner to said toner conveying means, and when the toner bottle selected is emptied, another toner bottle is selectable.

8. An apparatus as claimed in claim 7, wherein of said plurality of toner bottles, a toner bottle having a smallest frequency of replacement as determined by said counting means is selectable first.

9. An image forming apparatus for developing a latent image electrostatically formed on an image carrier to a toner image with a developing unit, and transferring the toner image to a recording medium, said image forming apparatus comprising:

a toner bank for storing toner to be replenished to said developing device;

toner conveying means for conveying the toner accumulated in a toner transport portion formed in said toner bank;

a plurality of toner containers set in said toner bank, each of said toner containers discharging toner from a respective mouth thereof to said toner transport portion; and a detector connected to said toner bank for detecting a frequency of use of an individual container of said plurality of containers and for determining the level of toner in said toner containers; and a passageway for feeding the toner from each of said plurality of toner containers to said toner transport portion.

10. An apparatus as claimed in claim 9, further comprising drive means for driving one of said plurality of tone containers to discharge toner via the respective mouth thereof.

11. An apparatus as claimed in claim 10, further comprising an anti-bridging member disposed in said passageway and interlocked to said drive means.

12. An apparatus as claimed in claim 9, further comprising a vent portion positioned above said passageway.

13. A device for replenishing toner to a developing unit, comprising:

a plurality of toner containers; and rotating means for rotating one of said plurality of toner containers to thereby replenish the toner to the developing unit;

said rotating means rotates all of said plurality of toner containers during replenishment; and detector means connected to said toner bank for detecting a frequency of use of an individual container of said plurality of containers and for determining the level of toner in said toner containers.

14. A device as claimed in claim 13, wherein said rotating means prevents an emptied toner container of said plurality of toner containers from rotating.

15. A device as claimed in claim 14, further comprising a plurality of impacting means each for applying a light impact to an associated one of said plurality of said toner containers in accordance with rotation of the associated toner container.

16. A device as claimed in claim 15, wherein said plurality of impacting means each impact the associated toner container with predetermined timing.

17. A device for replenishing toner to a developing unit, comprising:

a plurality of toner containers; and rotating means for rotating one of said plurality of toner containers to thereby replenish the toner to the developing unit;

wherein the toner container for replenishing toner and the toner container other than said toner container comprises a first and a second toner container, respectively, and said rotating means prevents said second toner container from rotating while toner replenishment from said first container is under way, but causes said second toner container to rotate for a preselected per od of time while the toner replenishment is not under way.

18. A device as claimed in claim 17, wherein said rotating means prevents an emptied one of said plurality of toner containers from rotating.

19. A device as claimed in claim 18, further comprising a plurality of impacting means each for applying a light impact to an associated one of said plurality of said toner containers in accordance with rotation of the associated toner container.

20. A device as claimed in claim 19, wherein said plurality of impacting means each impacts the associated toner container with predetermined timing.

21. An image forming device comprising:

a developing mechanism feeding toner to a latent image electrostatically formed on an image carrier;

a toner conveyor conveying the toner towards said developing mechanism;

a toner bank accommodating at least two toner bottles each storing the toner to be fed to said toner conveyer; and a detecting mechanism detecting a frequency of use of an individual toner bottle wherein the toner is fed from one of said plurality of toner bottles selected to be fed to said toner conveyor.

22. An apparatus as claimed in claim 21, wherein of said plurality of toner bottles, a toner bottle having a smallest frequency of use as determined by said detecting mechanism is selectable first.

23. An image forming apparatus, comprising:

a developing mechanism feeding toner to a latent image electrostatically formed on an image carrier;

a toner conveyor conveying the toner towards said developing mechanism;

a toner bank accommodating at least two toner bottles each storing the toner to be fed to said toner conveyor; and a detecting mechanism detecting a frequency of use of an individual toner bottle wherein the toner is fed from one of said plurality of toner bottles selected to be fed to said toner conveyor, and when the toner bottle selected is emptied, another toner bottle is selectable.

24. An apparatus as claimed in claim 23, wherein among said plurality of toner bottles, a toner bottle having a smallest frequency of use as determined by said detecting mechanism is selectable first.

25. An image forming apparatus, comprising:

a developing mechanism feeding toner to a latent image electrostatically formed on an image carrier;

a toner conveyor conveying the toner towards said developing mechanism;

a toner bank accommodating at least two replaceable toner bottles each storing the toner to be fed to said toner conveyor; and a counting mechanism determining a frequency of replacement of an individual toner bottle wherein the toner is fed from anyone of said plurality of toner bottles selected to feed toner to said toner conveyor.

26. An apparatus according to claim 25, wherein of said plurality of toner bottles, a toner bottle having a smallest frequency of replacement as determined by said counting mechanism is selectable first.

27. An image forming apparatus, comprising:

a developing mechanism feeding toner to a latent image electrostatically formed on an image carrier;

a toner conveyor conveying the toner towards said developing mechanism;

a toner bank accommodating at least two replaceable to Her bottles each storing the toner to be fed to said toner conveyor; and a counting mechanism determining a frequency of replacement of an individual toner bottle wherein the toner is fed from one of said plurality of toner bottles selected to feed toner to said toner conveyor, and when the toner bottle selected is emptied, another toner bottle is selectable.

28. An apparatus according to claim 27, wherein of said plurality of toner bottles, a toner bottle having a smallest frequency of replacement as determined by said counting mechanism is selectable first.

29. An image forming apparatus for developing a latent image electrostatically formed on an image carrier to a toner image with a developing unit, and transferring the toner image to a recording medium, said image forming apparatus comprising:

a toner bank storing toner to be replenished to said developing device;

a toner conveyor conveying the toner accumulated in a toner transport portion formed in the toner bank;

a plurality of toner containers set in said toner bank, each of said containers discharging toner from a respective mouth thereof to said toner transport portion; and a passageway feeding toner from each of said plurality of toner containers to said toner transport portion.

30. An apparatus as claimed in claim 29, further comprising a drive mechanism driving one of said plurality of toner containers to discharge the toner via a respective mouth thereof.

31. An apparatus as claimed in claim 30, further comprising an anti-bridging member disposed in said passageway and interlocked to said drive mechanism.

32. An apparatus as claimed in claim 29, further comprising a vent portion positioned above said passageway.

33. A device for replenishing toner to a developing u nit, comprising:

a plurality of toner containers; and a rotating mechanism rotating one of said plurality of toner containers to thereby replenish the toner to the developing unit;

a detector connected to said toner bank for detecting a frequency of use of an individual container of said plurality of containers and for determining the level of toner in said toner containers; and said rotating mechanism rotating all of said plurality of toner containers during replenishment.

34. A device as claimed in claim 33, wherein said rotating mechanism prevents an emptied toner container of said plurality of toner containers from rotating.

35. A device as claimed in claim 34, further comprising a plurality of impacting mechanisms applying a light impact to an associated one of said plurality of toner containers in accordance with rotation of the associated toner container.

36. A device as claimed in claim 35, wherein said plurality of impacting mechanisms each impact the associated toner container with predetermined timing.

37. A device for replenishing toner to a developing unit, comprising:

a plurality of toner containers;

a detector connected to said toner bank detecting a frequency of use of an individual container of said plurality of containers and for determining the level of toner in said toner containers; and a rotating mechanism rotating one of said plurality of toner containers to thereby replenish the toner to the developing unit wherein the toner container for replenishing the toner and a toner container other than said toner container comprise a first and second toner container, respectively, and a rotating mechanism for preventing said second toner container from rotating while toner replenishment from said first container is underway, but causes said second toner container to rotate for a preselected period of time while the toner replenishment is not underway.

38. A device as claimed in claim 37, wherein said rotating mechanism prevents an emptied one of said plurality of toner containers from rotating.

39. A device as claimed in claim 38, further comprising a plurality of impacting mechanisms applying a light impact to an associated one of said plurality of toner containers in accordance with rotation of the associated toner container.

40. A device as claimed in claim 39, when said plurality of impacting mechanisms each impact the associated toner container with a predetermined timing.

* * * * *